US010455922B2

(12) United States Patent
Beck

(10) Patent No.: US 10,455,922 B2
(45) Date of Patent: Oct. 29, 2019

(54) LOAD CARRIAGE FRAME

(71) Applicant: Tyr Tactical, LLC, Peoria, AZ (US)

(72) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 0 days.

(21) Appl. No.: 15/610,097

(22) Filed: May 31, 2017

(65) Prior Publication Data

US 2017/0347777 A1 Dec. 7, 2017

Related U.S. Application Data

(60) Provisional application No. 62/344,316, filed on Jun. 1, 2016.

(51) Int. Cl.

| | |
|---|---|
| ***A45F 3/08*** | (2006.01) |
| ***A45F 3/10*** | (2006.01) |
| ***A45F 3/14*** | (2006.01) |

(52) U.S. Cl.

CPC ..... *A45F 3/08* (2013.01); *A45F 3/10* (2013.01); *A45F 3/14* (2013.01); *A45F 2003/144* (2013.01)

(58) Field of Classification Search

CPC ..... A45F 3/08; A45F 3/10
USPC ..... 224/633, 634, 635, 636
See application file for complete search history.

(56) References Cited

U.S. PATENT DOCUMENTS 990,837 A * 5/1911 Carlson ..... A45F 3/04 224/633
1,040,413 A * 10/1912 Renard ..... A45F 3/04 224/153
3,219,243 A * 11/1965 Mack ..... A45F 3/10 224/262
3,347,429 A * 10/1967 Ruth, Jr. ..... A45F 3/04 224/235
3,563,431 A * 2/1971 Pletz ..... A45F 3/08 224/262

(Continued)

FOREIGN PATENT DOCUMENTS

| | | |
|---|---|---|
| CA | 797075 | 10/1968 |
| JP | 59163560 | 11/1984 |

OTHER PUBLICATIONS

Extended European Search Report, dated Oct. 2, 2017, and Published Application, published Dec. 6, 2017, in corresponding application No. 17173759.6.

(Continued)

*Primary Examiner* — Justin M Larson
(74) *Attorney, Agent, or Firm* — KW Law, LLP

(57) ABSTRACT

Implementations described and claimed herein provide systems and methods for load carriage using a load carriage apparatus. In one implementation, a frame top is disposed at a proximal end of a load carriage frame. The frame top includes a proximal bar and a distal bar each extending between a first side bar and a second side bar. A frame base is disposed at a distal end of the load carriage frame, and the frame base includes a rear portion connected to a first side portion and a second side portion. A spine connects a center portion of the proximal bar of the frame top to the rear portion of the frame base. A first tube extends from the first side bar to the frame base relative to the first side portion. A second tube extends from the second side bar to the frame base relative to the second side portion.

20 Claims, 26 Drawing Sheets

(56) References Cited

U.S. PATENT DOCUMENTS 3,827,612 A * 8/1974 Mead ..... A45F 3/10 224/262
3,897,894 A * 8/1975 Lawrence ..... A45F 3/10 224/261
4,009,809 A * 3/1977 Morris ..... A45F 3/10 211/189
4,154,381 A * 5/1979 Zufich ..... A45F 3/08 224/262
4,214,685 A * 7/1980 Pletz ..... A45F 3/04 224/634
4,303,186 A * 12/1981 Ollinger, IV ..... A45F 3/08 224/634
4,361,259 A * 11/1982 Chanter ..... A45F 3/08 224/635
4,480,775 A * 11/1984 Stanford ..... A45F 3/14 224/161
4,911,346 A * 3/1990 Shallman ..... A45F 3/08 224/153
4,982,884 A * 1/1991 Wise ..... A45F 3/04 224/197
5,464,137 A * 11/1995 Shirdavani ..... A41F 9/002 2/45
5,492,255 A * 2/1996 Gansky ..... A01M 31/02 224/153
5,503,314 A * 4/1996 Fiscus ..... A45F 3/08 224/262
5,564,612 A * 10/1996 Gregory ..... A45F 3/08 224/633
5,846,169 A * 12/1998 Tscheschlog ..... A63B 21/4005 224/265
5,904,282 A * 5/1999 Gleason ..... A45F 3/08 224/263
9,055,806 B2 * 6/2015 Ferrer Wetter ..... A45F 3/10
9,332,821 B2 * 5/2016 Janssen ..... A45F 3/04
9,370,237 B2 * 6/2016 Hiemenz ..... A45F 3/04
9,629,443 B2 * 4/2017 Searle ..... A45F 3/10
2003/0127483 A1 * 7/2003 Black ..... A43B 5/0425 224/628
2007/0251965 A1 * 11/2007 Mosley ..... A45F 3/047 224/637
2014/0224849 A1 * 8/2014 Hiemenz ..... A45F 3/04 224/271
2014/0305982 A1 * 10/2014 Pelland ..... A45F 3/06 224/576
2016/0022018 A1 * 1/2016 Searle ..... A45F 3/08 224/266
2016/0309884 A1 * 10/2016 Sellers ..... A45F 3/10
2017/0049218 A1 * 2/2017 Moncreiff ..... A45F 3/08
2017/0092244 A1 * 3/2017 Shigenaga ..... A45F 3/10

OTHER PUBLICATIONS

Examiner's Report dated Mar. 19, 2018, in corresponding Australian application No. 2017203713.

* cited by examiner

LOAD CARRIAGE FRAME

CROSS-REFERENCE TO RELATED APPLICATION

The present application claims the benefit of priority under 35 U.S.C. § 119(e) to U.S. Provisional Application No. 62/344,316, entitled "Load Carriage Frame," filed on Jun. 1, 2016, which is specifically incorporated by reference in its entirety herein.

TECHNICAL FIELD

Aspects of the present disclosure relate to systems and methods for load carriage and more particularly to a load carriage frame for distributing a weight of a load, such as tactical equipment, for carrying by an individual, while accommodating the movement and ergonomics of the individual.

BACKGROUND

Packs and similar loads are often carried on the back of an individual. In certain contexts, such as tactical and backpacking environments, the weight of such packs can become exceptionally large. For example, during military conflicts, an expeditionary soldier may be carrying a load weighing as much as ninety pounds over sizable distances. When the weight of the load is concentrated on the back of an individual, the burden of carrying the load dramatically increases on the individual. Accordingly, load carriage devices are utilized to distribute the weight of the load and thereby facilitate carrying. Conventional load carriage devices, however, often: are rigid and prone to breakage; inhibit movement of the individual; adds substantially to the weight of the load; and are uncomfortable during use. It is with these observations in mind, among others, that various aspects of the present disclosure were conceived and developed.

SUMMARY

Implementations described and claimed herein address the foregoing problems by providing systems and methods for load carriage using a load carriage apparatus. In one implementation, a frame top is disposed at a proximal end of a load carriage frame. The frame top includes a proximal bar and a distal bar each extending between a first side bar and a second side bar. A frame base is disposed at a distal end of the load carriage frame, and the frame base includes a rear portion connected to a first side portion and a second side portion. A spine connects a center portion of the proximal bar of the frame top to the rear portion of the frame base. A first tube extends from the first side bar to the frame base relative to the first side portion, and a second tube extends from the second side bar to the frame base relative to the second side portion.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1:
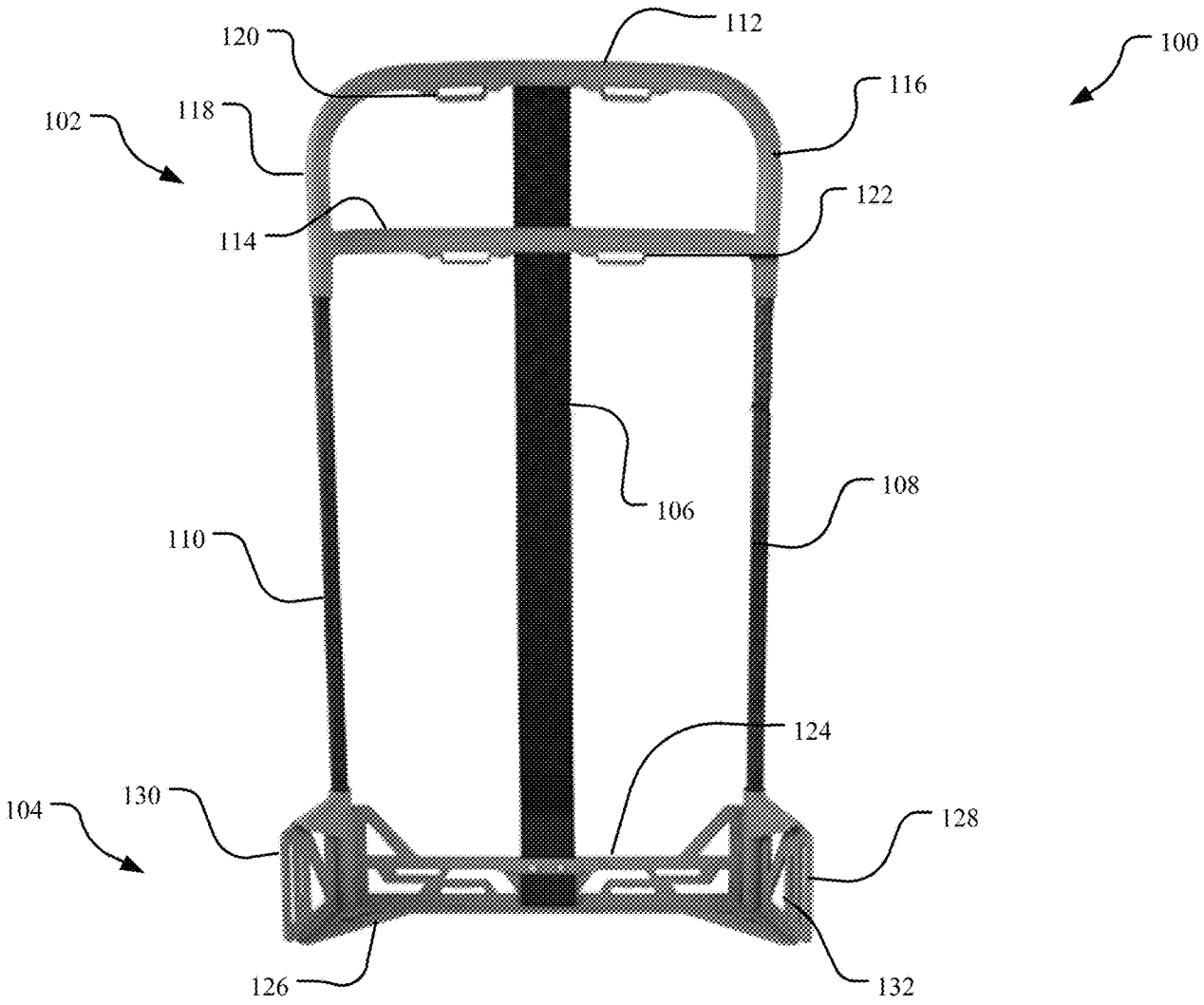
FIG. 1 is a front view of an example load carriage frame.
Figure 2:
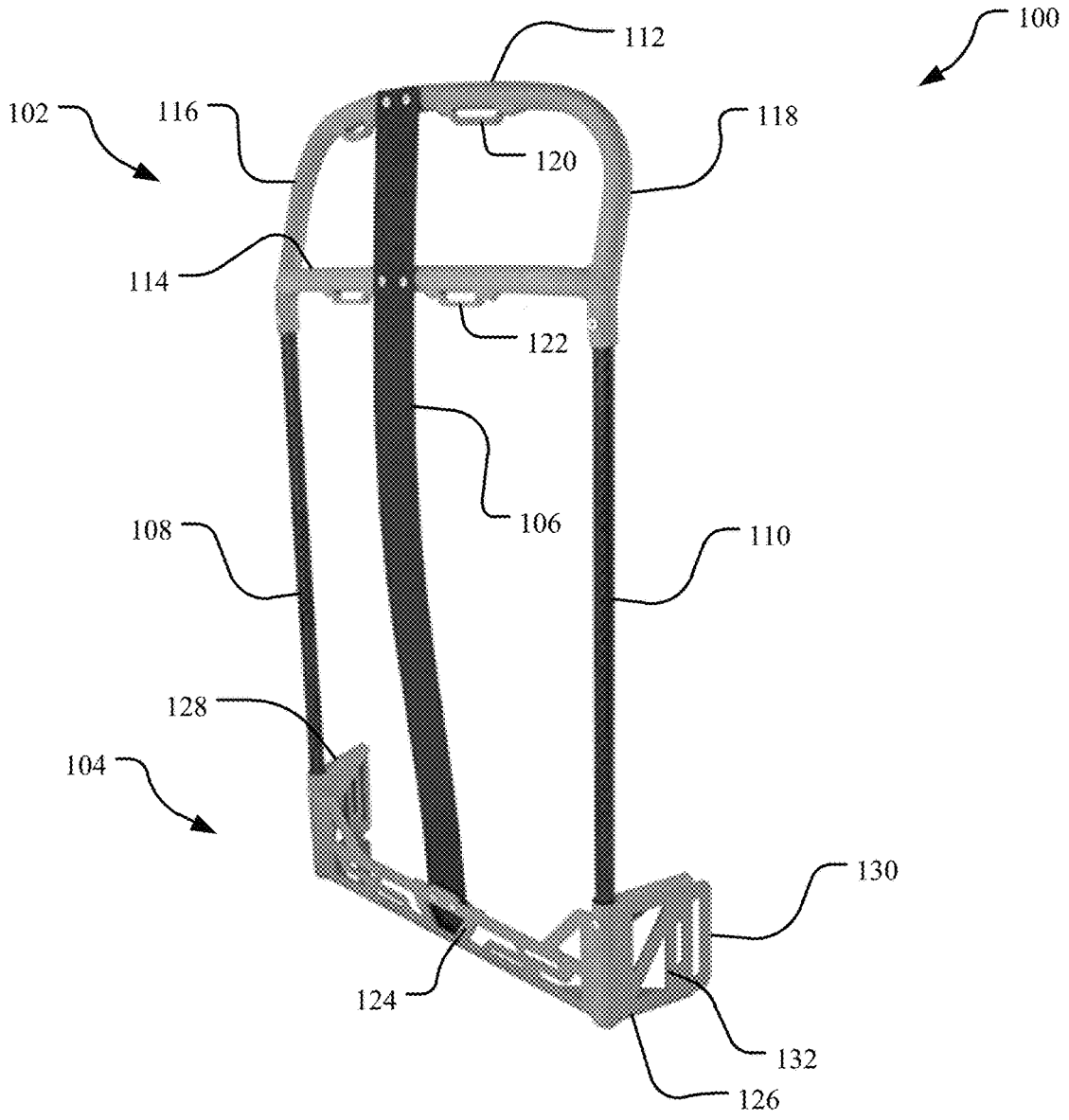
FIG. 2 is a left perspective view of the load carriage frame.
Figure 3:
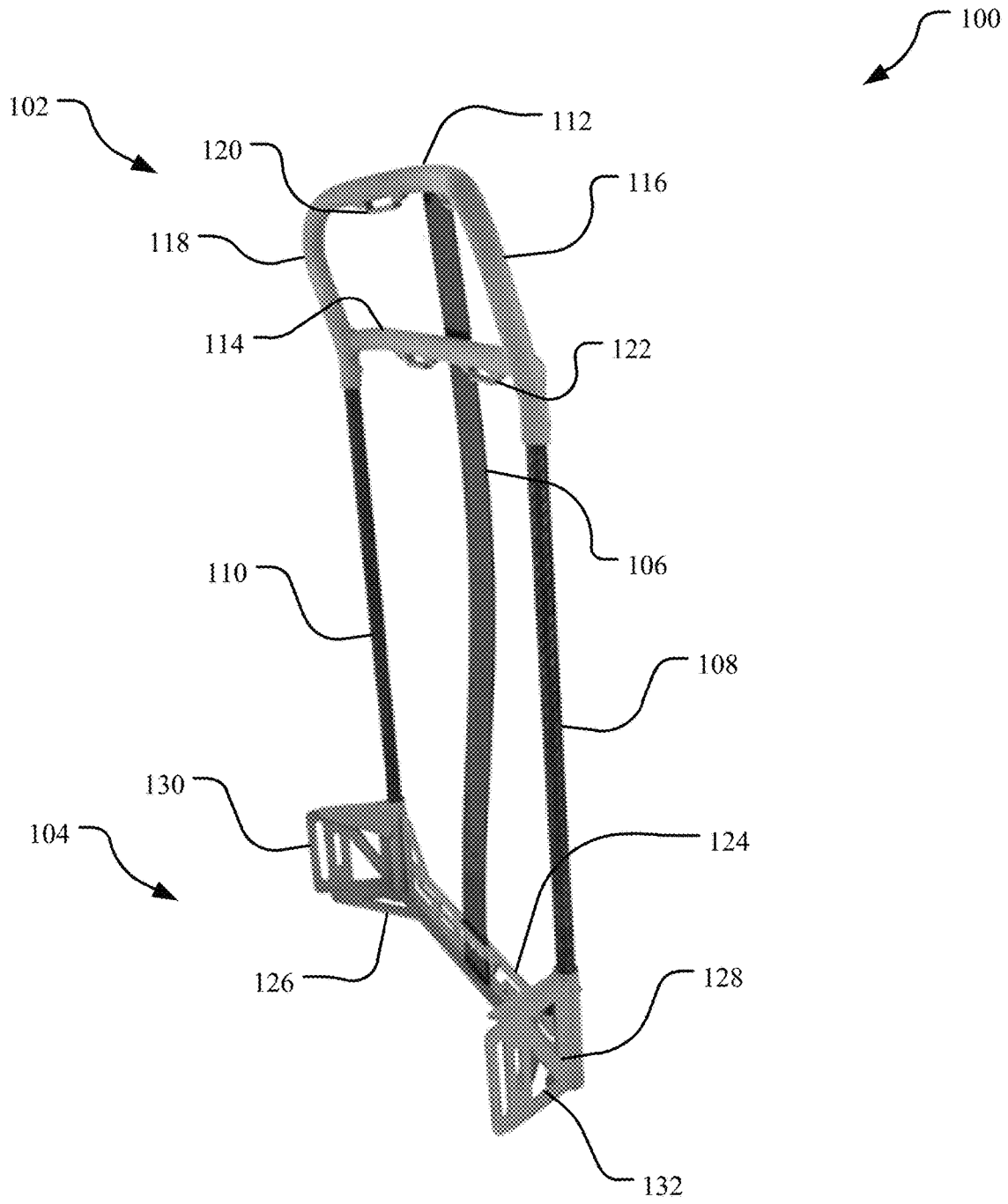
FIG. 3 is a right perspective view of the load carriage frame.
Figure 4:
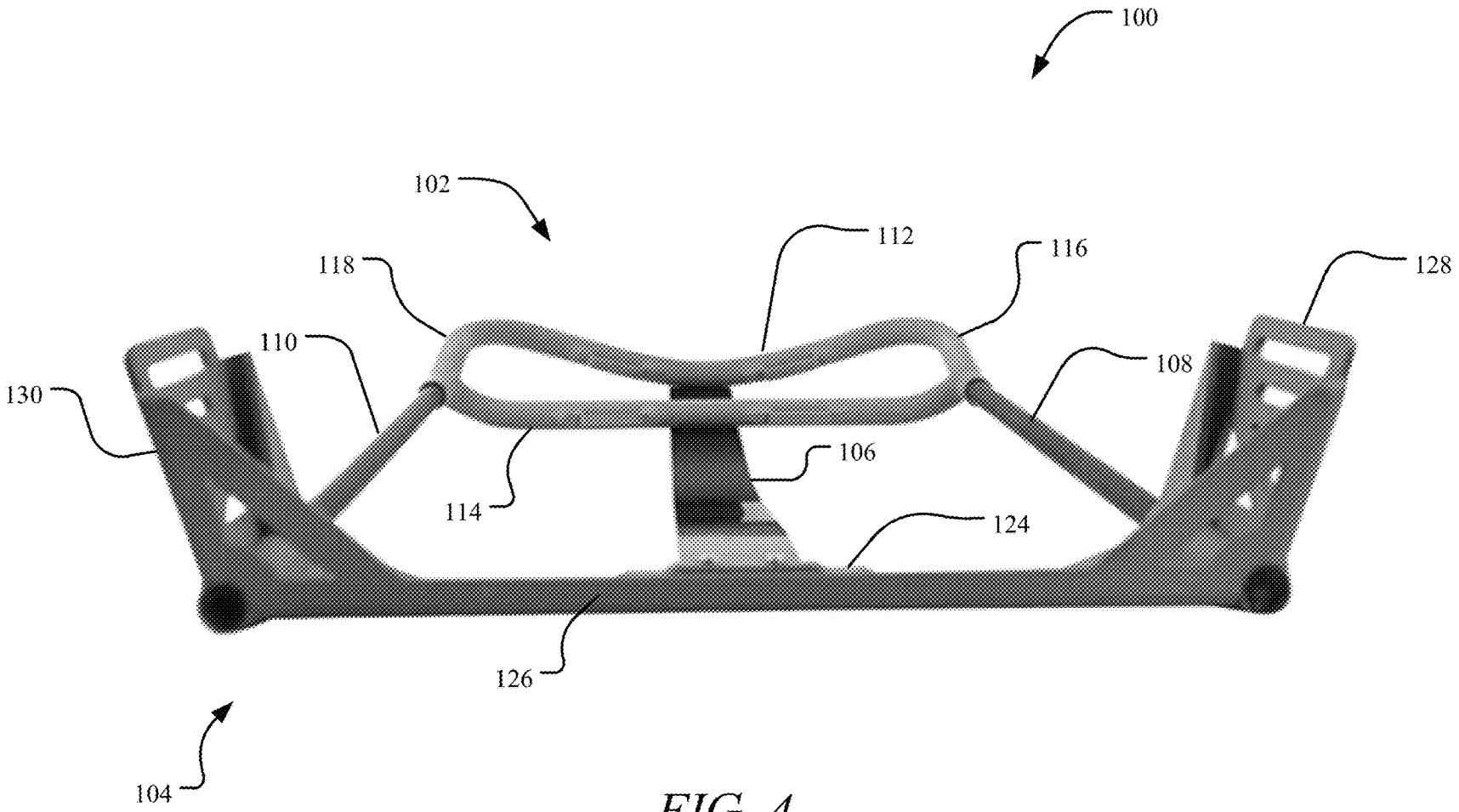
FIG. 4 is a bottom perspective view of the load carriage frame.

Aspects of the present disclosure involve systems and methods for load carriage. In one particular aspect, an angled load carriage frame is provided that distributes a weight of a load, such as tactical equipment, across the back, hips, and waist of an individual. The load carriage frame includes a frame top and a frame base connected by a flexible spine and opposing carbon fiber tubes. The frame base angles outwardly to accommodate the movement and ergonomics of the individual. Similarly, the frame top curves outwardly at a center portion of a proximal bar to accommodate movement of the head of the individual. The flexible spine is adapted to reverberate energy to resist breakage of the load carriage frame. The load carriage frame is generally constructed from strong, durable, lightweight materials, such as carbon fiber and/or aluminum, thereby providing an enhanced strength-to-weight ratio. A load carriage assembly, including a yoke, yoke adapter, and base belt connected to the load carriage frame, may be used to carry a load, such as a pack and/or other tactical equipment.

The various systems and methods disclosed herein generally provide for load carriage. The example implementations discussed herein reference tactical equipment. However, it will be appreciated by those skilled in the art that the presently disclosed technology is applicable to other loads and contexts, such as backpacking, climbing, camping, hiking, and/or other contexts involving carriage of a heavy load over a sizable distance.

To begin a detailed description of an example load carriage frame 100 for carrying a load, reference is made to FIGS. 1-4. In one implementation, the load carriage frame 100 includes a frame top 102 disposed at a proximal end of the load carriage frame 100 and a frame base 104 disposed at a distal end of the load carriage frame 100. The frame top 102 is connected to the frame base 104 with a spine 106, a first tube 108, and a second tube 110. The frame top 102 and the frame base 104 may be made from metal, plastic, glass, and/or other lightweight, strong, durable materials. In one implementation, the frame top 102 and the frame base 104 are made from aluminum. The spine 106 may be made from a flexible material that is adapted to reverberate energy, for example, caused by a shift in the load or by hitting a portion of the load carriage frame 100 against an object. The first tube 108 and the second tube 110 may be made from a similar lightweight, strong, durable material, such as carbon fiber. The load carriage frame 100 is thus lightweight, strong, and durable. For example, the load carriage frame 100 may weigh approximately one pound, providing an enhanced strength-to-weight ratio.

In one implementation, the frame top 102 includes a proximal bar 112 and a distal bar 114, each extending between a first side bar 116 and a second side bar 118. The proximal bar 112 may be integral with the first side bar 116 and the second side bar 118 to form a top tube, with the distal bar 114 welded thereto. The top tube and/or the distal bar 114 may extend along various contours to distribute a weight of the load while accommodating the ergonomics and movement of an upper body and head of an individual wearing the load carriage frame 100. For example, the frame top 102 may be sized and shaped to prevent the individual from hitting his head on a portion of the frame top 102, such as the proximal bar 112, as well as to accommodate a shape of a back of the individual. More particularly, the first and second side bars 116 and 118 may extend along a contour inwardly to accommodate the shape of the back of the individual. Similarly, the proximal bar 112 may extend along a contour outwardly to accommodate the head of the wearer. The distal bar 114 may extend outwardly at each of the first side bar 116 and the second side bar 118 prior to extending transversely across the frame top 102 to prevent the distal bar 114 from digging into the back of the individual and to otherwise permit uninhibited movement of the individual during carriage. To facilitate mounting of a load to the load carriage frame 100, the frame top 102 may include one or more eyelets through which straps may be inserted and secured. For example, one or more proximal eyelets 120 may be disposed along the proximal bar 112, and one or more distal eyelets 122 may be disposed along the distal bar 114.

As shown in FIGS. 1-4, the spine 106 extends from the proximal bar 112 of the frame top 102 to the frame base 104, the first tube 108 extends from the first side bar 116 to the frame base 104, and the second tube 110 extends from the second side bar 118 to the frame base 104. In one implementation, the spine 106 extends from a center portion of the proximal frame 112 to a rear portion 124 of the frame base 104. The rear portion 124 is connected to a base portion 126, a first side portion 128, and a second side portion 130 to form the frame base 104. In one implementation, the rear portion 124 is oriented perpendicularly to the base portion 126 and at an obtuse angle relative to the first side portion 128 and the second side portion 130. The obtuse angle orientation of the rear portion 124 and the first and second side portions 128 and 130 accommodates the ergonomics of the hips of the individual and permits uninhibited movement of the individual. The frame base 104 may include one or more openings 132 having a variety of shapes, including but not limited to, triangular, oval, elliptical, circular, trapezoidal, rectangular, angled, contoured, and/or the like. The openings 132 are adapted to receive and secure straps or other portions of a load carriage assembly, such as a yoke, yoke adapter, belt, and/or the like to mount the load to the load carriage frame 100.

Figure 5A:
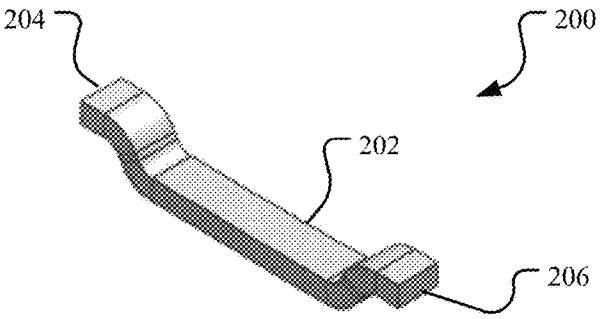
FIG. 5A illustrates an example bracket for the load carriage frame.
Figure 5B:
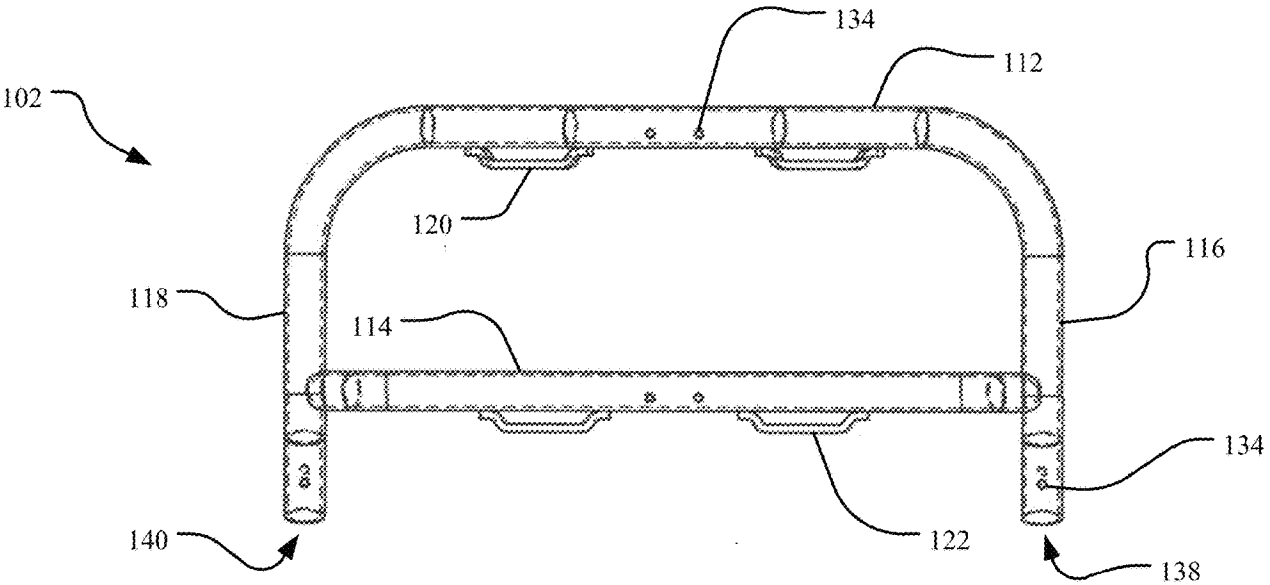
FIG. 5B shows a front view of a frame top of the load carriage frame.
Figure 6B:
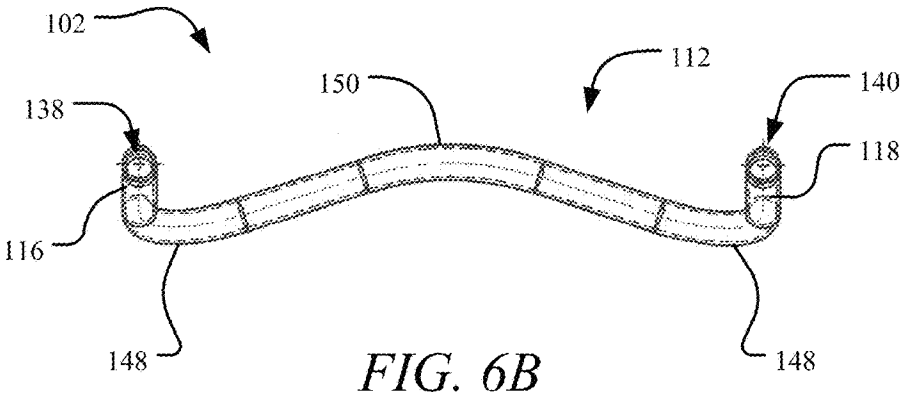
FIGS. 6A, 6B, and 6C illustrate side, bottom perspective, and perspective views, respectively of the frame top with the brackets and distal bar removed for clarity.
Figure 6C:
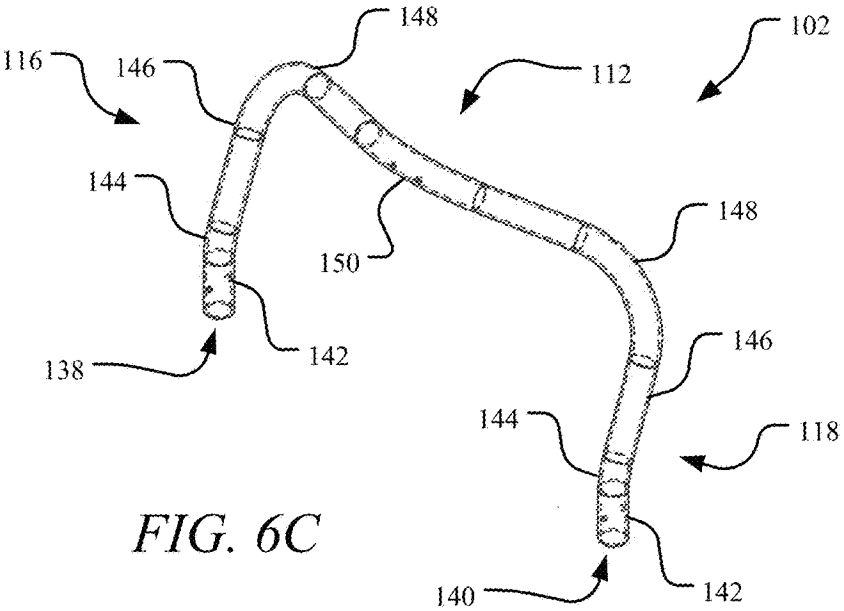
Figure 6A:
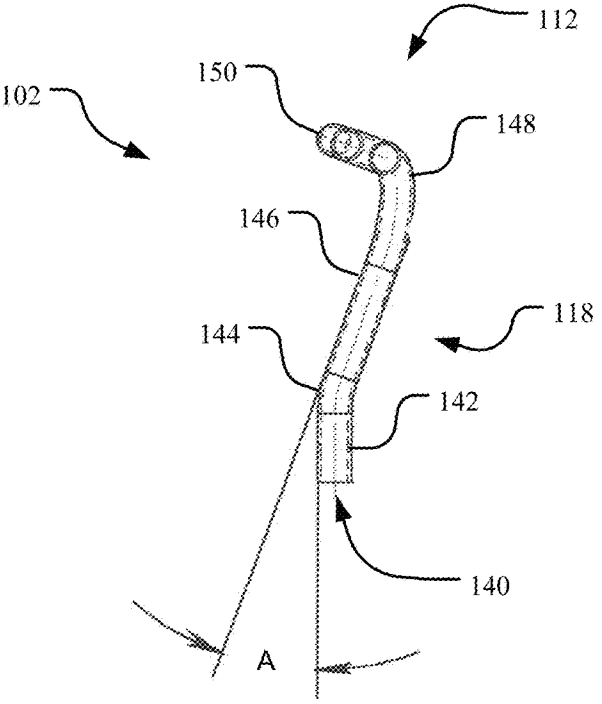

Turning to FIGS. 5A-5B, in one implementation, a bracket 200 may be mounted to the frame top 102 to form an eyelet, such as the proximal eyelet(s) 120 and/or the distal eyelet(s) 122. The bracket 200 may be made from a material similar to or the same as the frame top 102, such as aluminum, for example. In one implementation, the bracket 200 includes an elongated body 202 extending between a first end 204 and a second end 206. The elongated body 202 may extend linearly in a center portion and along a contour at each of the first end 204 and at the second end 206. This shape of the bracket 200 forms an eyelet opening when the elongated body 204 is connected to a portion of the frame top 102 at the first and second ends 204 and 206. The bracket 200 may be connected to the frame top 102 using a variety of methods, such as welding. As can be understood from FIG. 5B, in one implementation, the frame top 102 includes one or more holes 134 extending therethrough to connect the frame top 102 to the spine 106, the first tube 108, and/or the second tube 110.

As can be understood from FIGS. 5B-6C, the proximal bar 112 may be integral with the first side bar 116 and the second side bar 118 to form a top tube. In one implementation, the top tube has a lumen extending therethrough from a first opening 138 to a second opening 140. The first and second side bars 116 and 118 may each include a distal section 142 connected to a proximal section 146 by a transition section 144. The distal section 142 extends linearly from the first tube 108 or the second tube 110, and the transition section 144 transitions the first and second side bars 116 and 118 to the proximal section 146, which extends inwardly at an angle A from the distal section 142. In one implementation, the angle A is approximately twenty degrees to mirror the contours of the back of the individual. Each of the first and second side bars 116 and 118 transitions from the proximal section 146 to the proximal bar 112 along a connecting portion 148. In one implementation, the connecting portion 148 extends along a contour from the proximal section 146 to a furthest inward point and back to a furthest outward point disposed in a center portion 150 of the proximal bar 112. The shape created by the connecting portions 148 and the center portion 148 accommodates the head of the individual.

Figure 7A:
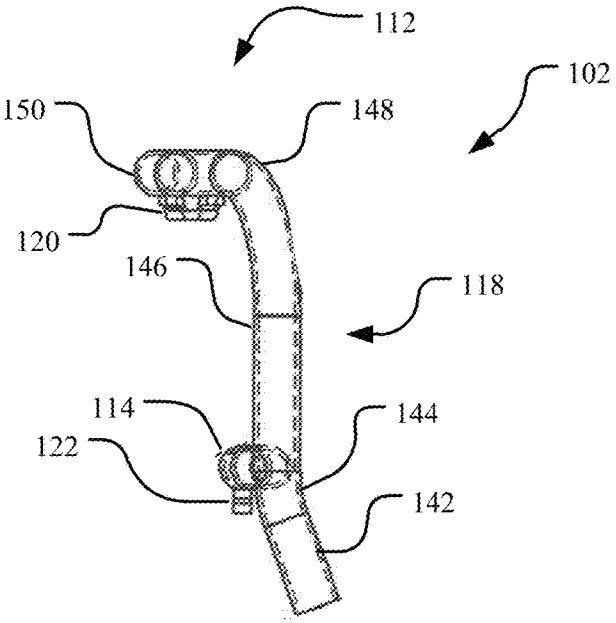
FIGS. 7A and 7B show side and bottom perspective views, respectively, of the frame top.
Figure 7B:
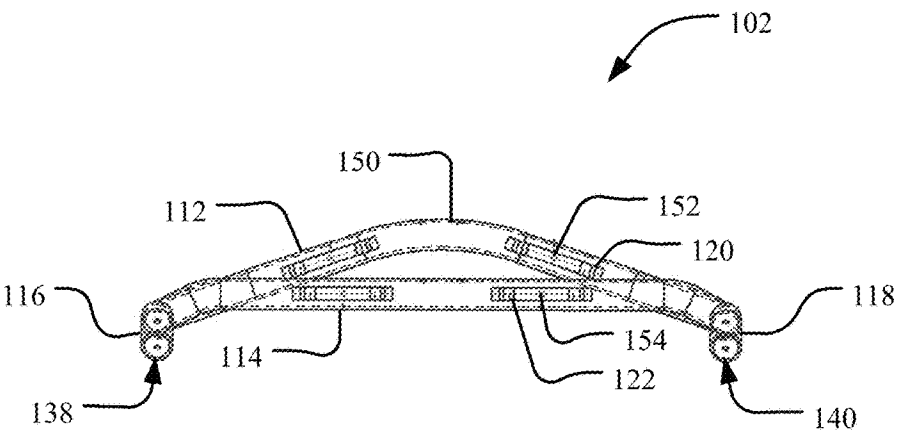
Figure 8A:
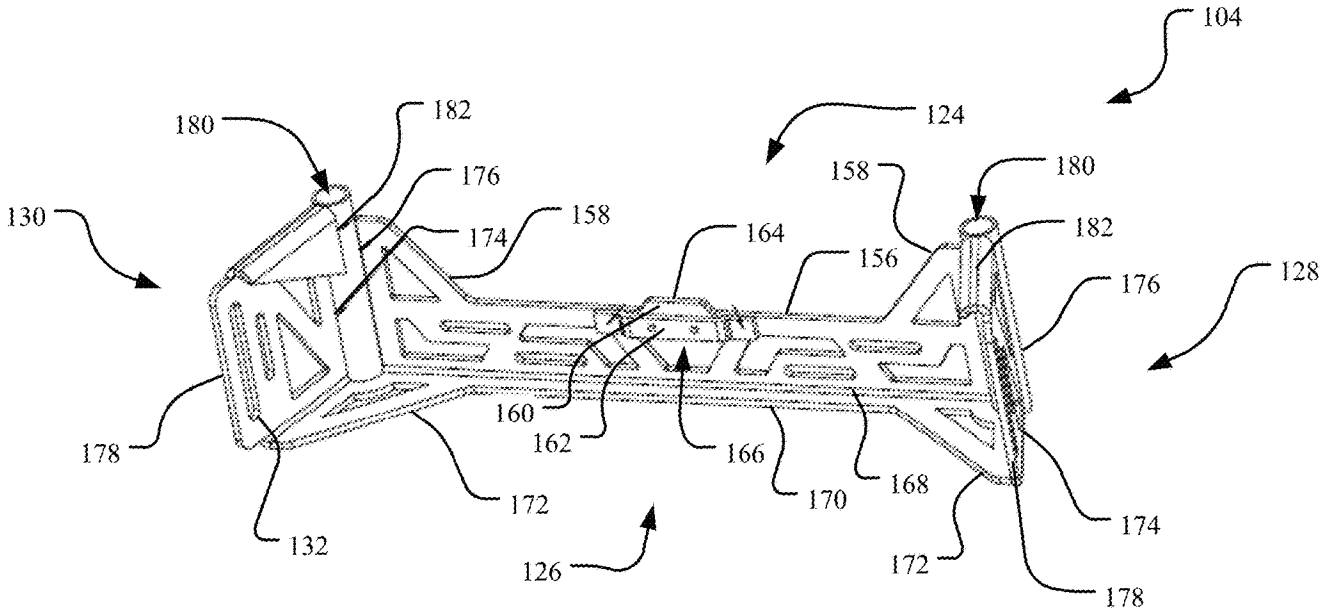
FIGS. 8A and 8B illustrate a front perspective view and a side view, respectively, of a frame base of the load carriage frame.
Figure 8B:
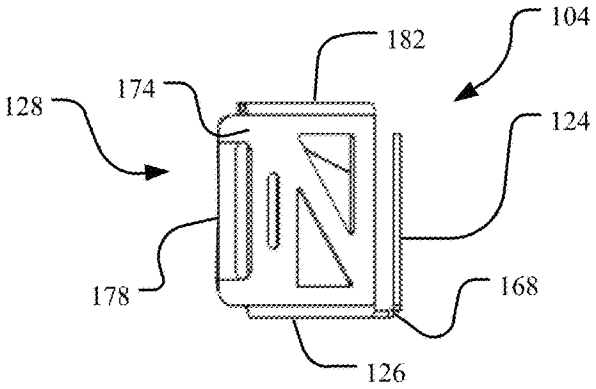
Figure 9A:
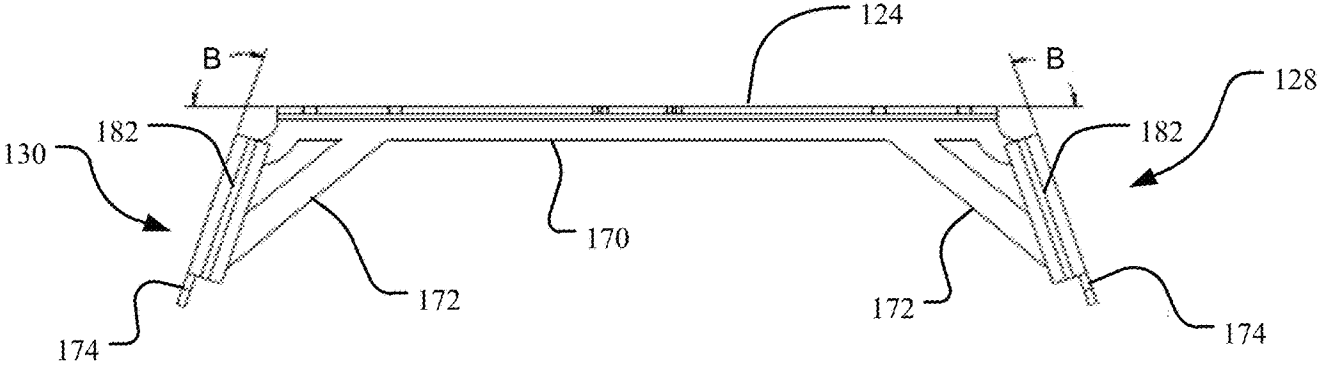
FIGS. 9A and 9B show a top and front view, respectively, of the frame base.
Figure 9B:
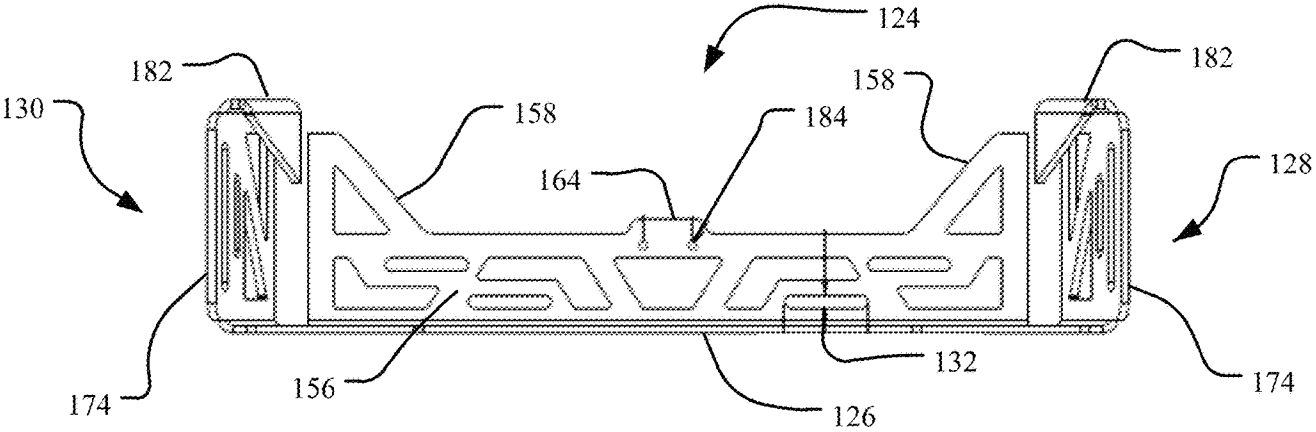

As can be understood from FIGS. 7A-7B, the distal bar 114 may extend outwardly at each of the first side bar 116 and the second side bar 118 prior to extending transversely across the frame top 102 to prevent the distal bar 114 from digging into the back of the individual and to otherwise permit uninhibited movement of the individual during carriage. Stated differently, the distal bar 114 may include a first end portion and a second end portion oriented at an angle of approximately twenty-five degrees relative to a crossbar portion, such that the crossbar portion extends linearly between the first end portion and the second end portion which then curve to connect to the first side bar 116 and the second side bar 118, respectively. In one implementation, due to the contours of the proximal bar 112 and the distal bar 114, a distance between a center 152 of each of the proximal eyelets 120 may be greater than a distance between a center 154 of each of the distal eyelets 122.

To begin a detailed description of the frame base 104, reference is made to FIGS. 8A-10. In one implementation, the rear portion 124 includes a rear body 156 extending between the first side portion 128 and the second side portion 130. The rear body 156 may include one or more of the openings 132. In one implementation, the rear portion 124 includes wings 158 extending from a proximal edge of the rear body 156. Stated differently, a length of the rear portion 124 tapers distally until meeting the proximal edge of the rear body 156. As discussed herein, the spine 106 connects to the rear portion 124. In one implementation, the rear portion 124 includes a tab 164 extending proximally from the proximal edge of the rear body 156. A bracket 162, which may be similar to the bracket 200, is mounted to a front surface 160 of the rear body 156 to create a channel 166 adapted to receive the spine 106. The bracket 162 may include one or more holes defined therein and mirroring holes 184 in the rear body 156 to receive bolts to secure the spine 106 to the frame base 104.

In one implementation, the rear portion 124 is connected to a base body 170 of the base portion 126 along a bending portion 168. The base body 170 may include one or more of the openings 132. Similar to the rear portion 124, the base portion 126 may include wings 172 extending from a front edge of the base body 170. Stated differently, a length of the base portion 126 tapers outwardly until meeting the front edge of the base body 170. The rear wings 158 and the base wings 172 accommodate the ergonomics of hips and movement of the individual.

The frame base 104 may include one or more receivers 176 extending proximally from the base portion 126 and including an opening 180. In one implementation, one of the receivers 176 is disposed between the rear portion 124 and the first side portion 128, and another of the receivers 176 is disposed between the rear portion 124 and the second side portion 130. The receivers 176 are adapted to receive and secure the first tube 108 and the second tube 110. In one implementation, the first and second side portions 128 and 130 each include a side body 174 extending inwardly along an angle B from the receiver 176 to a front edge 178. The angle B is an obtuse angle, which may be approximately 109 degrees. The angle B further accommodates the ergonomics of hips and movement of the individual. The side body 174 may include one or more of the openings 132. In one implementation, a cover 182 extends over a proximal edge of the side body 174.

Figure 10:
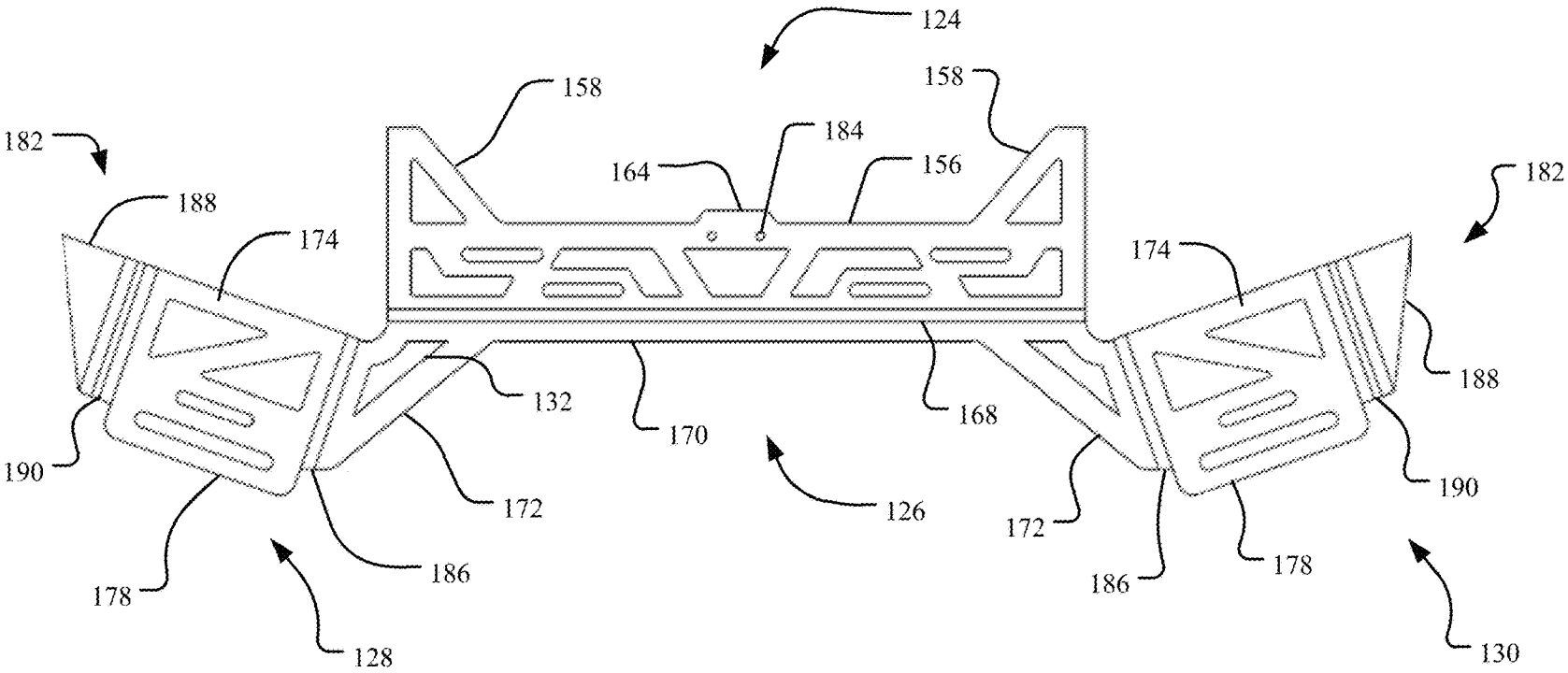
FIG. 10 illustrates the frame base oriented flat prior to assembly.

As can be understood from FIG. 10, in one implementation, the frame base 104 is one integral component that is formed by folding the rear portion 124, the base portion 126, and the first and second side portions 128 and 130 relative to each other for welding or similar method. The rear portion 124 and the base portion 126 may be folded relative to each other along the bending portion 168. In one implementation, the rear portion 124 and the base portion 126 are folded into a perpendicular orientation relative to each other. Similarly, the base portion 126 and each of the side portions 128 and 130 may be folded relative to each other alongside bending portions 186. In one implementation, the base portion 126 and each of the side portions 128 and 130 are folded into a perpendicular orientation relative to each other. After folding the side portions 128 and 130 in this manner, the base wings 172 position the side portions 128 and 130 at an obtuse angle (e.g., approximately 109 degrees) relative to the rear portion 124. The covers 182 each include a cover body 188 that may be folded along a cover bending portion 190 relative to each of the side portions 128 and 130.

As described herein, the load carriage frame 100 may be used with a load carriage assembly to facilitate carrying of a load. Examples of such load carriage assemblies and methods related to connecting such example load carriage assemblies to the load carriage frame 100 are illustrated in FIGS. 11A-23B.

Figure 11B:
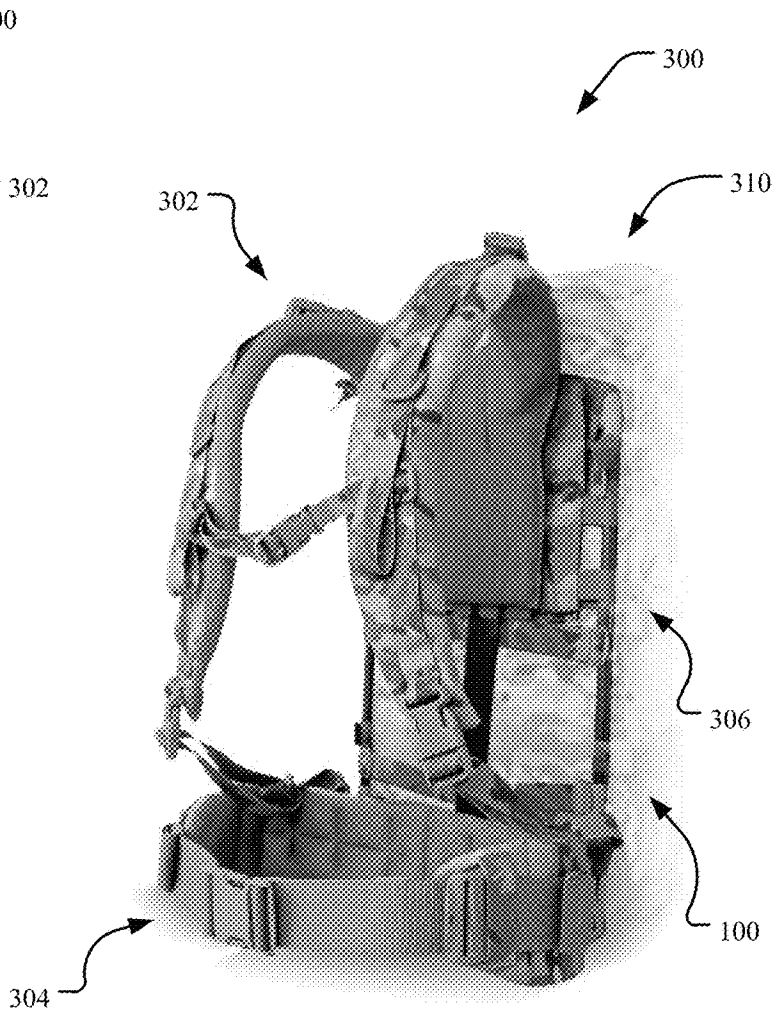
FIG. 11B illustrates an example load in the form of a tactical pack mounted to the load carriage assembly.
Figure 11A:
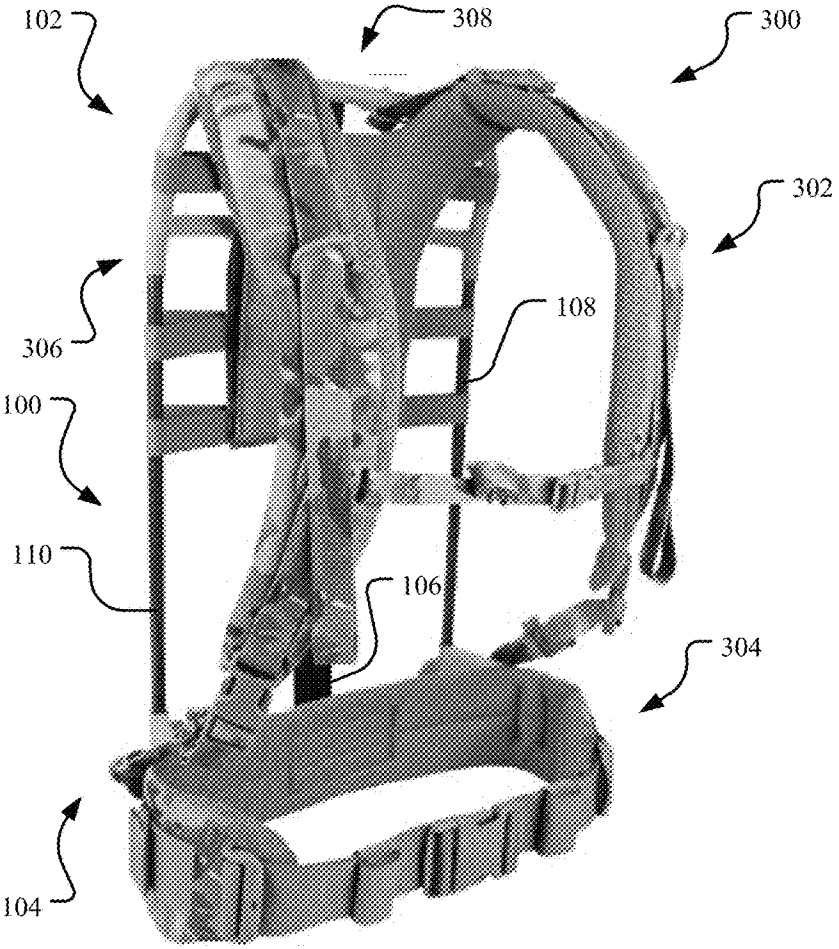
FIG. 11A shows an example load carriage assembly including the load carriage frame.

Turning first to FIGS. 11A-11B, in one implementation, the load carriage frame 100 is connected to a load carriage assembly 300, including a yoke 302, a base belt 304, a yoke adapter 306, and a carry handle adapter 308. The yoke 302 is mounted to the load carriage frame 100 with the yoke adapter 306, and the base belt 304 is mounted to the load carriage frame 100. The yoke 302 and the base belt 304 are adapted to be worn by the individual to carry a load 310, such as tactical equipment. More particularly, the yoke 302 is worn by the upper body of the individual, and the base belt 304 attaches to the waist of the individual. The load 310 is mounted to the load carriage frame 100 for carrying by the individual with the weight distributed across the upper body and waist of the individual. As can be understood from FIGS. 12A-12B, in one implementation, the carry handle adapter 308 is mounted to the center portion 150 of the frame top 102 between the proximal eyelets 120 and outside the spine 106 to facilitate lifting of the load carriage system, including the load carriage frame 100, the load 310, and the load carriage assembly 300.

Figure 12A:
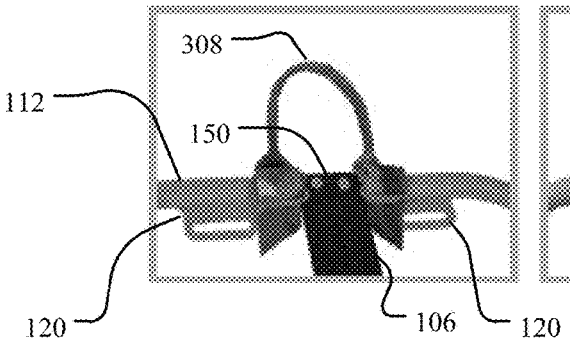
FIGS. 12A and 12B show rear and front views of an example carry handle adapter mounted to the load carriage frame.
Figure 12B:
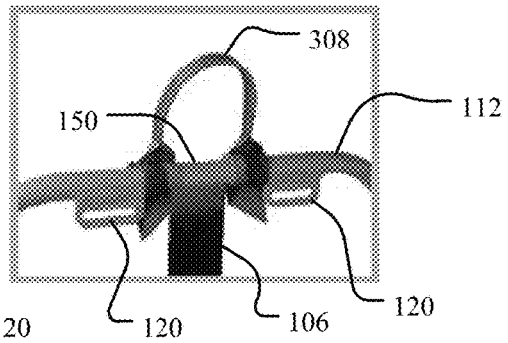
Figure 12C:
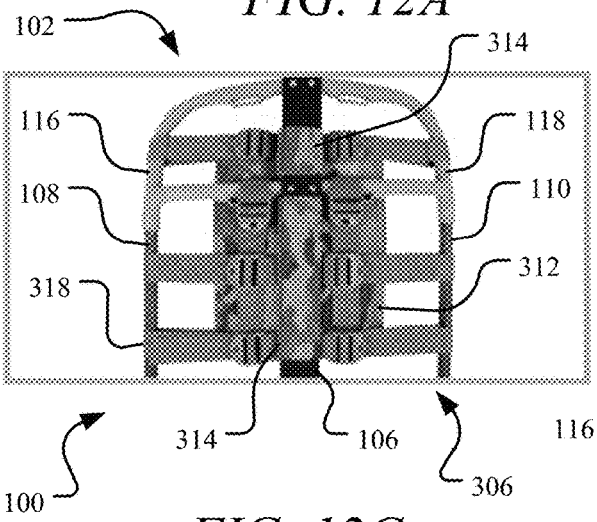
FIGS. 12C and 12D show an example yoke adapter mounted to the load carriage frame.
Figure 12D:
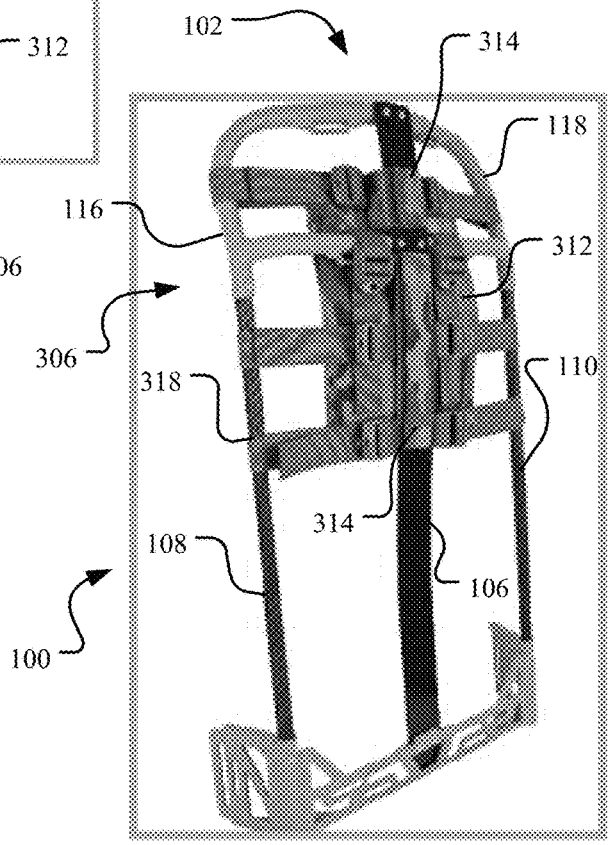
Figure 13A:
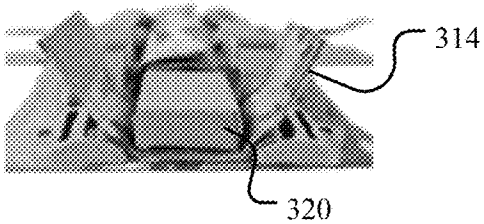
FIGS. 13A and 13B illustrate a spine strap disengaged and engaged, respectively, to a shock absorber.
Figure 13B:
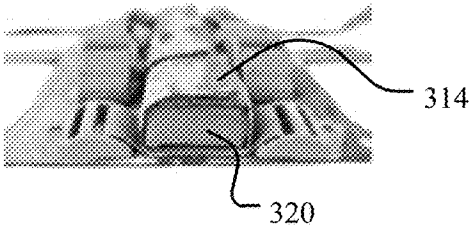
Figure 13C:
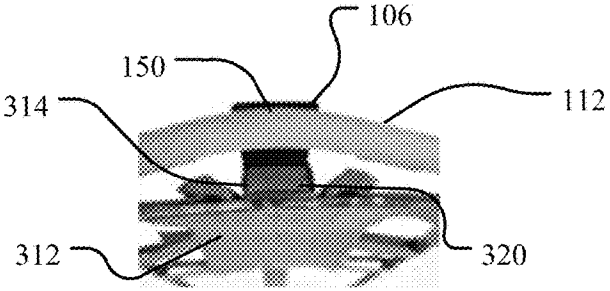
FIG. 13C shows the spine strap engaged to a spine of the load carriage frame.

Referring to FIGS. 12C and 12D, in one implementation, the yoke adapter 306 includes a webbed body 312 with one or more spine straps 314 and adapter straps 318 connected thereto. The yoke adapter 306 is mounted to the load carriage frame 100 at the proximal end. In one implementation, the spine straps 314 are mounted to the spine 106 using paired hook and loop fasteners, and the adapter straps 318 are each looped around a portion of the frame top 102 or a portion of the first tube 108 or a portion of the second tube 110. As shown in FIGS. 13A-13C, in one implementation, a shock absorber support 320 may be positioned against the spine 106, for example, on the front side, using the spine straps 324.

Figure 14A:
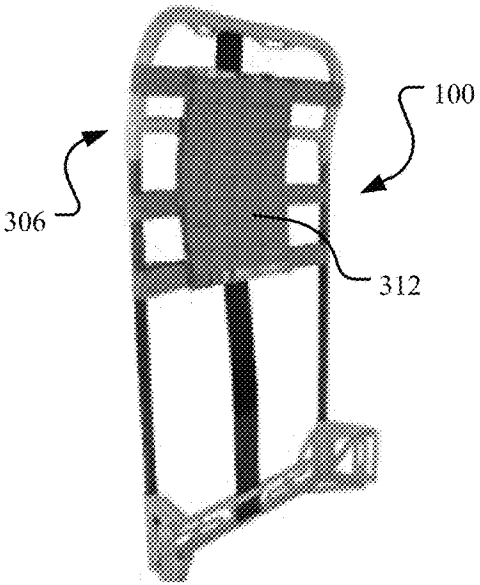
FIG. 14A shows a perspective view of the yoke adapter mounted to the load carriage frame.
Figure 14B:
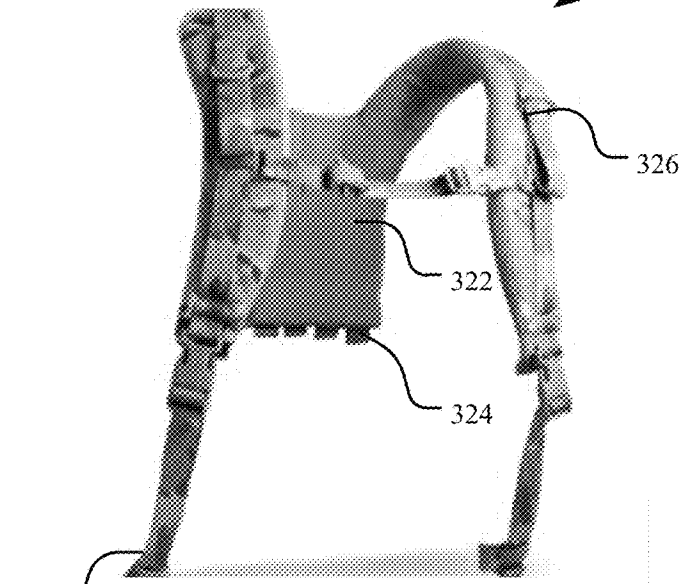
FIG. 14B illustrates an example yoke.
Figure 14C:
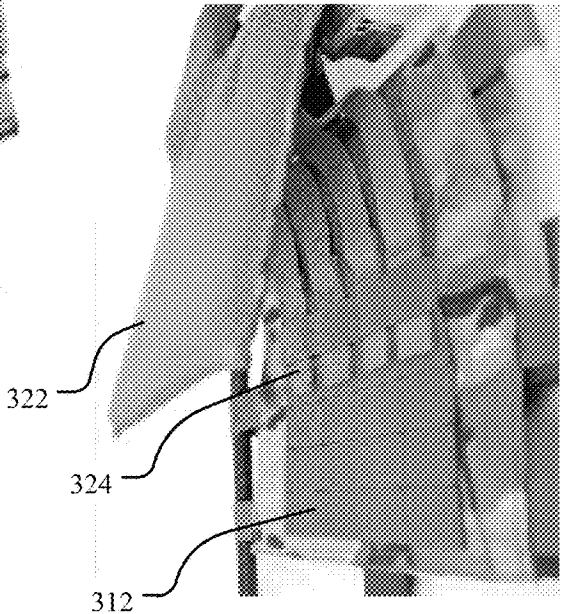
FIG. 14C illustrates the yoke in the process of being engaged to the yoke adapter with MOLLE.

As can be understood from FIGS. 14A-14C, in one implementation, the yoke 302 includes a yoke support 322 having yoke arms 326 extending therefrom. The yoke support 322 has padding adapted to contact the back of the individual, and the yoke arms 326 have padding adapted to extend over the shoulders of the individual. A strap may connect the yoke arms 326. In one implementation, yoke straps 324 extend from a rear surface of the yoke support 322 and are adapted for insertion through the webbing of the webbed body 312. Stated differently, the individual may MOLLE the yoke 302 to the yoke adapter 306 using the yoke straps 324 and the webbed body 312. A shoulder strap 328 extends from each of the yoke arms 326 for anchoring to the frame base 104.

Figure 15B:
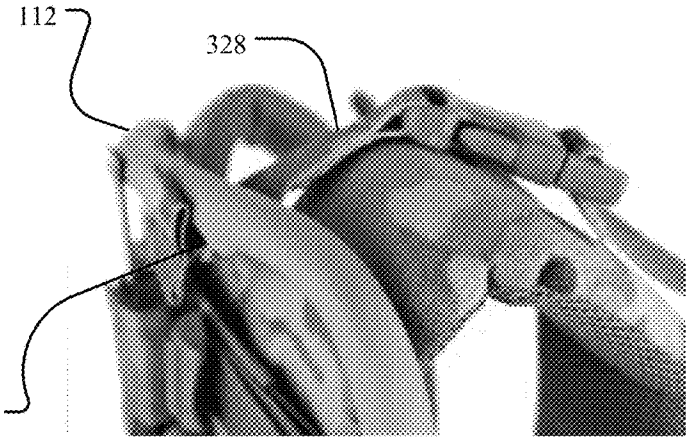
FIGS. 15A-15C illustrate example retention straps of the yoke being engaged to eyelets of the frame top.
Figure 15A:
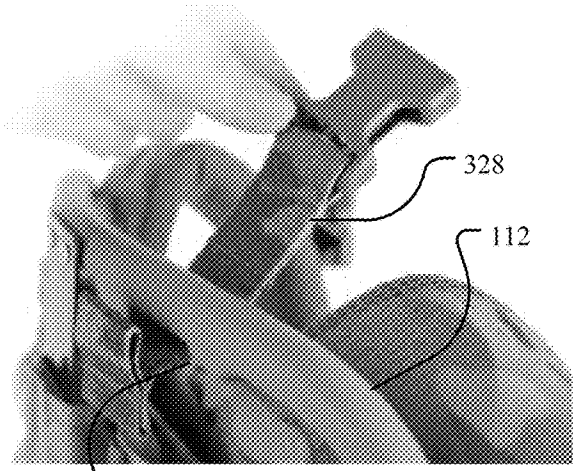
Figure 15C:
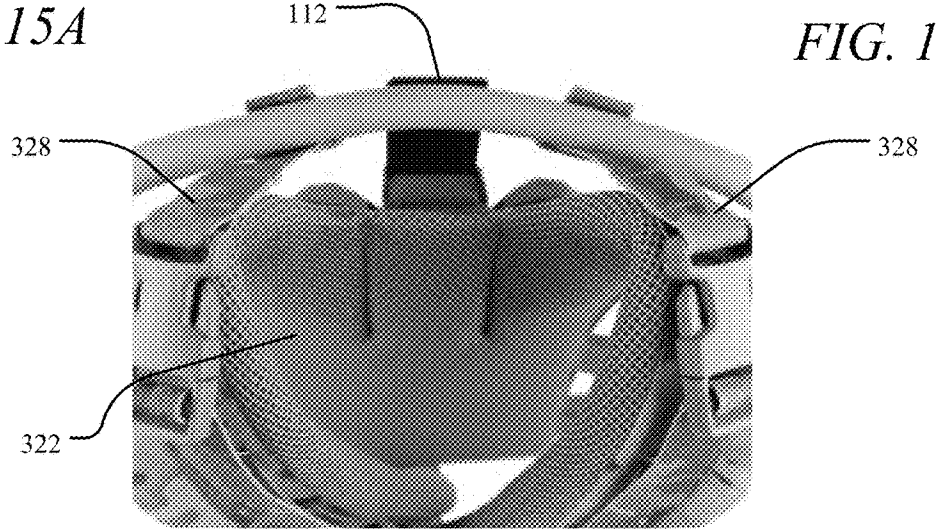
Figure 16B:
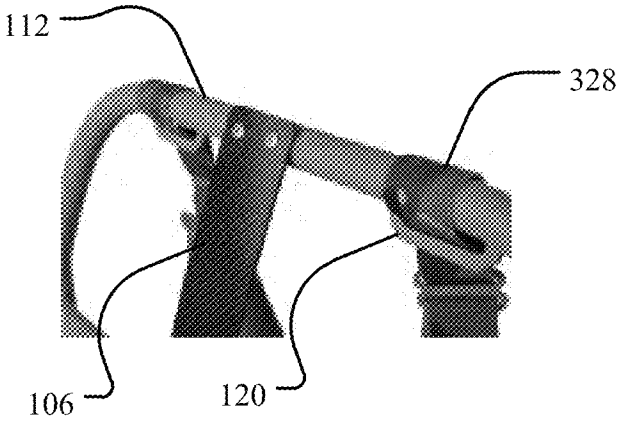
FIGS. 16A-16B illustrate another example of retention straps of the yoke being engaged to eyelets of the frame top.
Figure 16A:
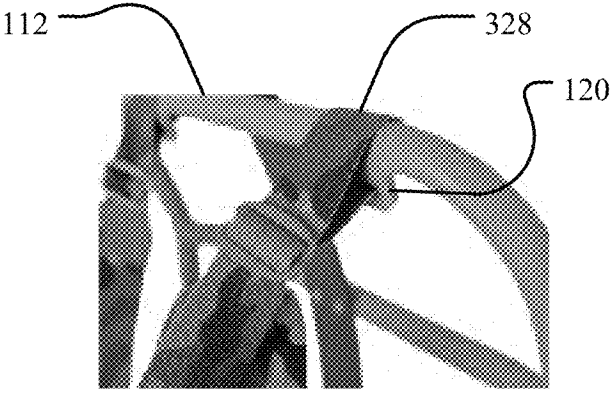

Turning to FIGS. 15A-15C, in one implementation, one or more yoke retention straps 328 may be used to further secure the yoke 302 to the frame top 102. For example, a female buckle portion of the yoke retention strap(s) 328 may be inserted through the eyelets(s) 120 and secured using a male buckle portion. In another example shown in FIGS. 16A-16B, the yoke retention strap(s) 328 may be inserted through the eyelet(s) 120 and looped back through a buckle for securing.

Figure 17B:
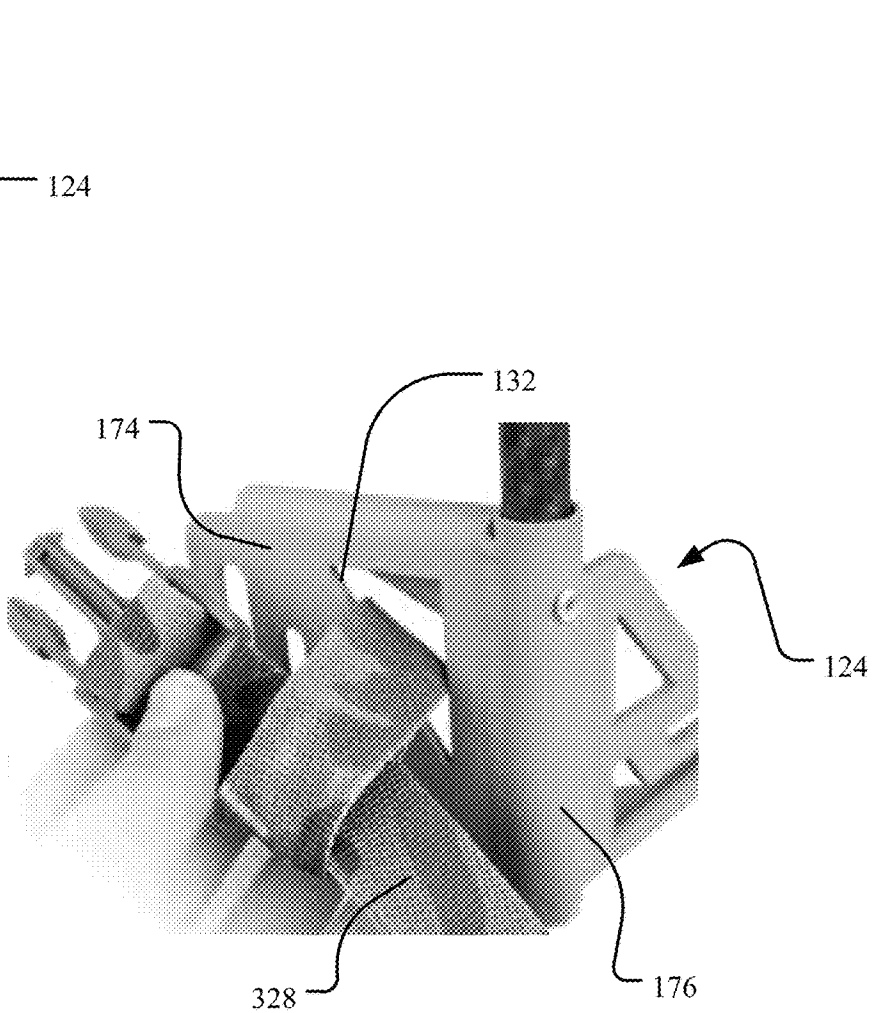
FIGS. 17A and 17B show example shoulder straps of the yoke being anchored to the frame base through one or more openings.
Figure 17A:
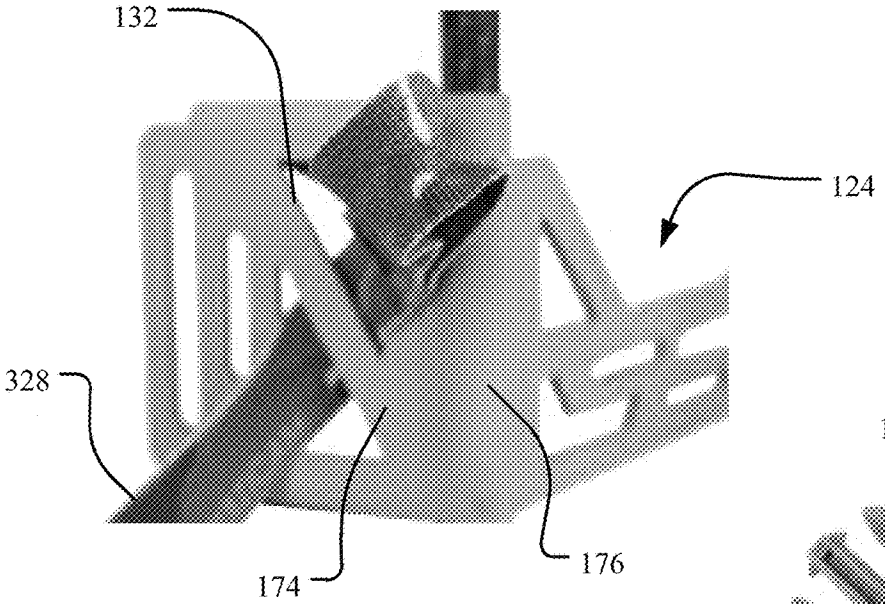

As can be understood from FIGS. 17A-17B, in one implementation, the yoke shoulder straps 328 are each anchored to the frame base 104 by inserting a loop of the yoke shoulder strap 328 through one of the openings 132 for a male buckle portion to be inserted through the loop for securing to a female buckle portion.

Figure 18:
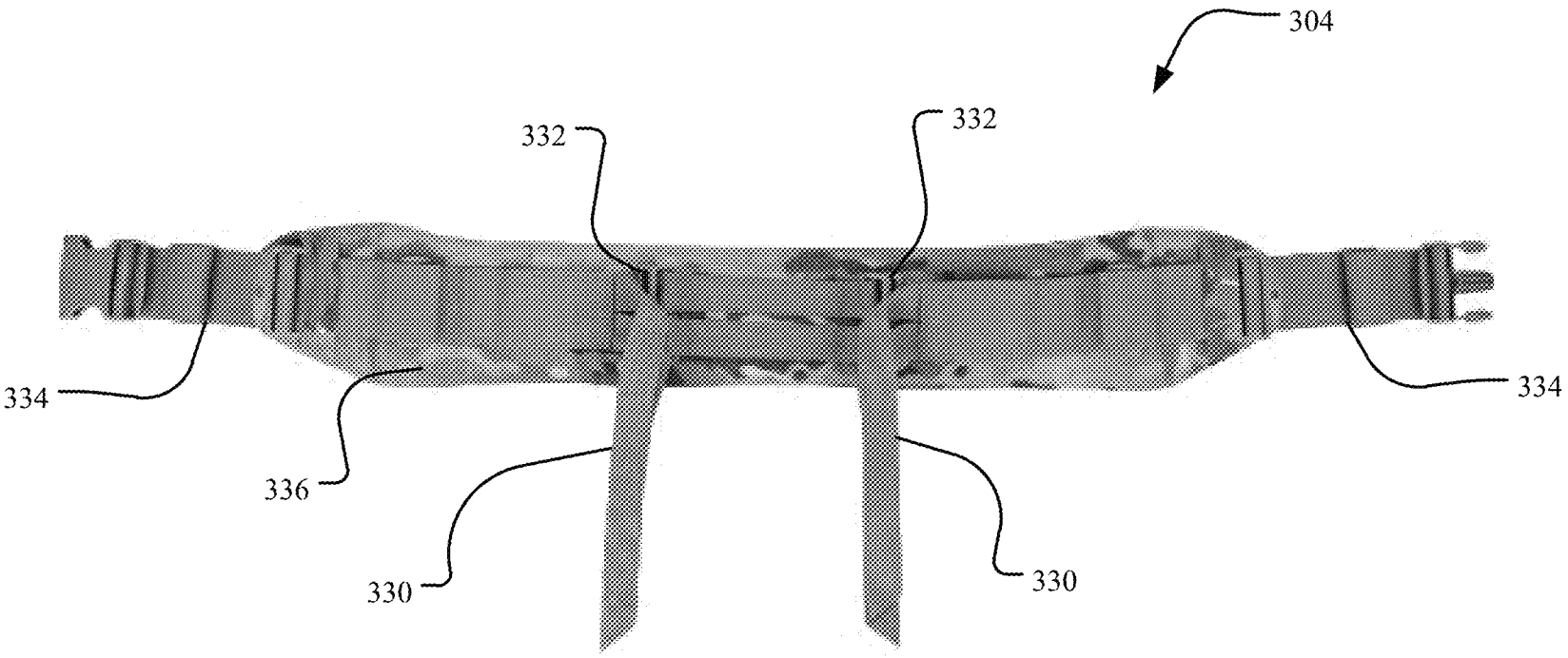
FIG. 18 illustrates an example base belt.
Figure 19B:
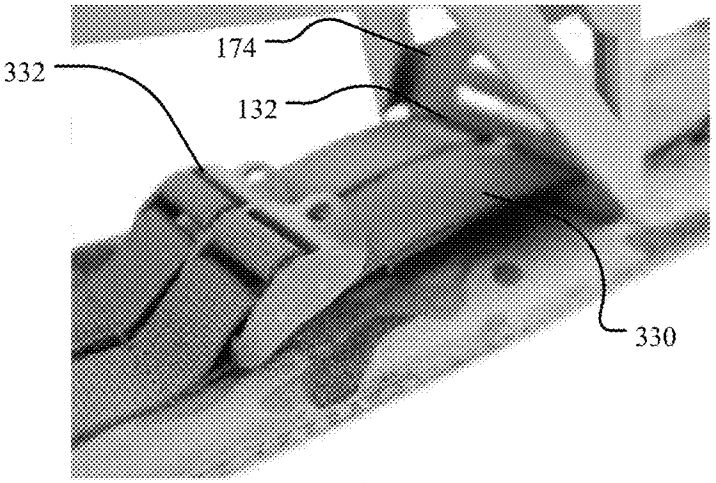
FIGS. 19A-19D illustrate example retention straps of the belt being secured to the base belt through the one or more openings.
Figure 19A:
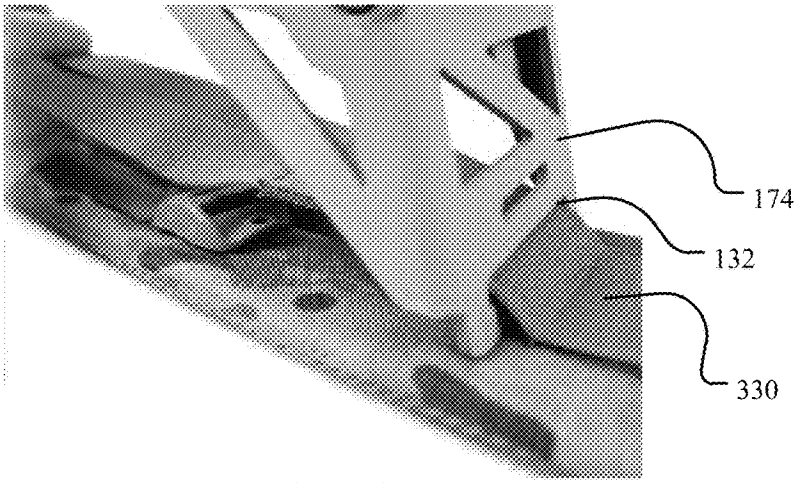
Figure 19D:
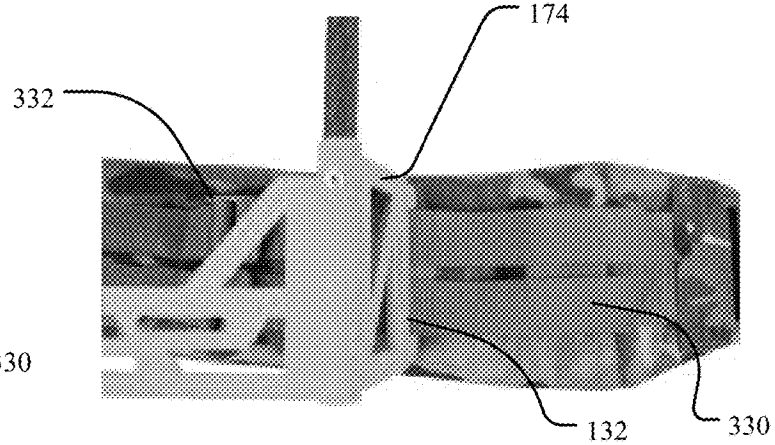
Figure 19C:
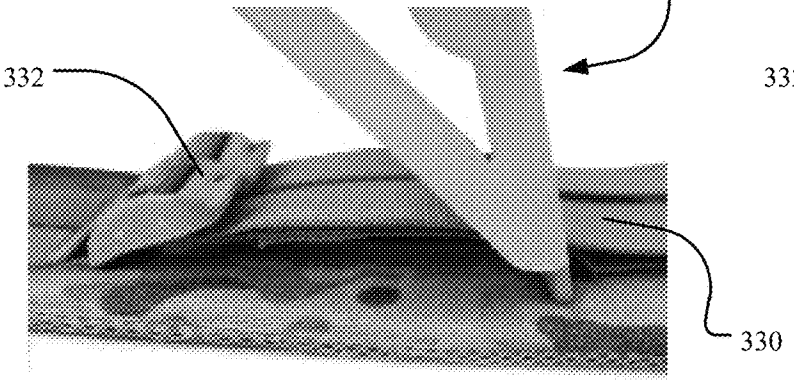
Figure 20A:
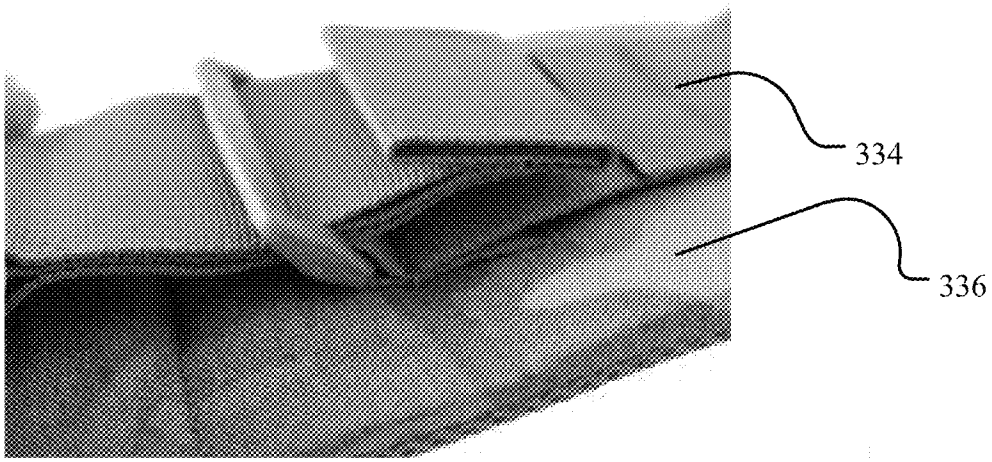
FIGS. 20A and 20B show an example base belt adapter being connected to the base belt.
Figure 20B:
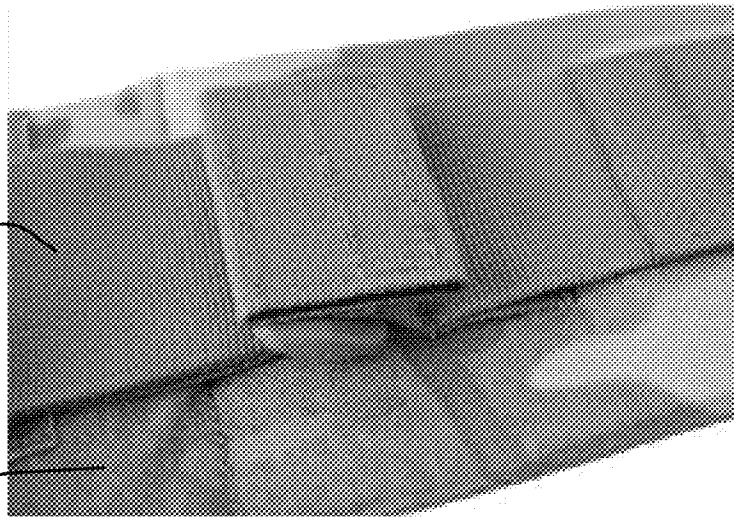
Figure 21:
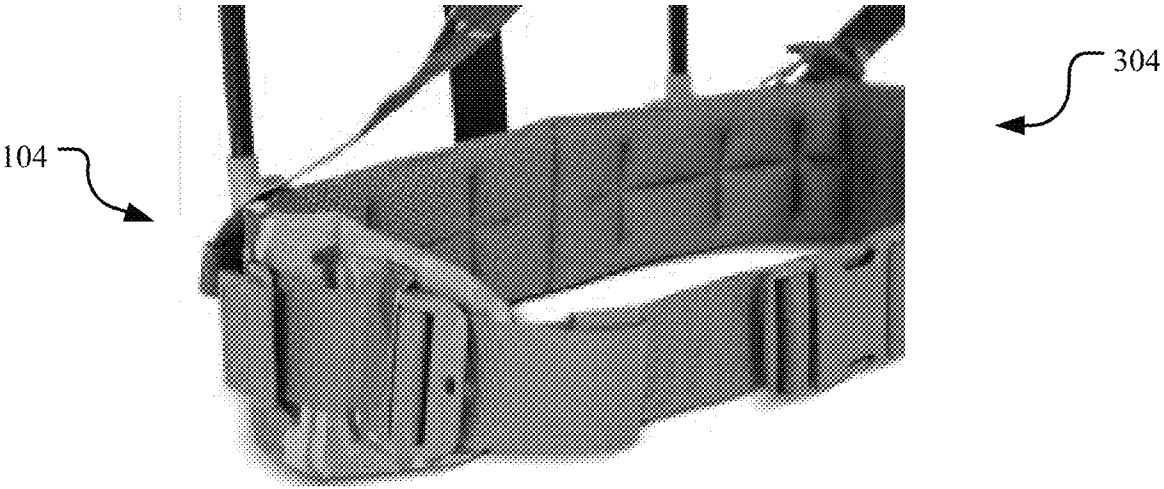
FIG. 21 shows the base belt engaged to the frame base.
Figure 22A:
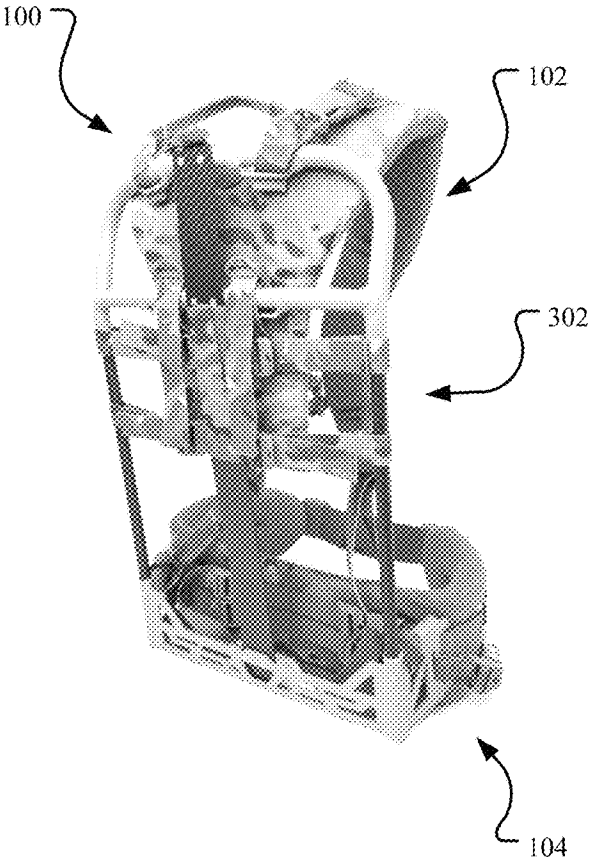
FIG. 22A-22B show a back elevated perspective view and a side view, respectively, of an example yoke engaged directly to the frame.
Figure 22B:
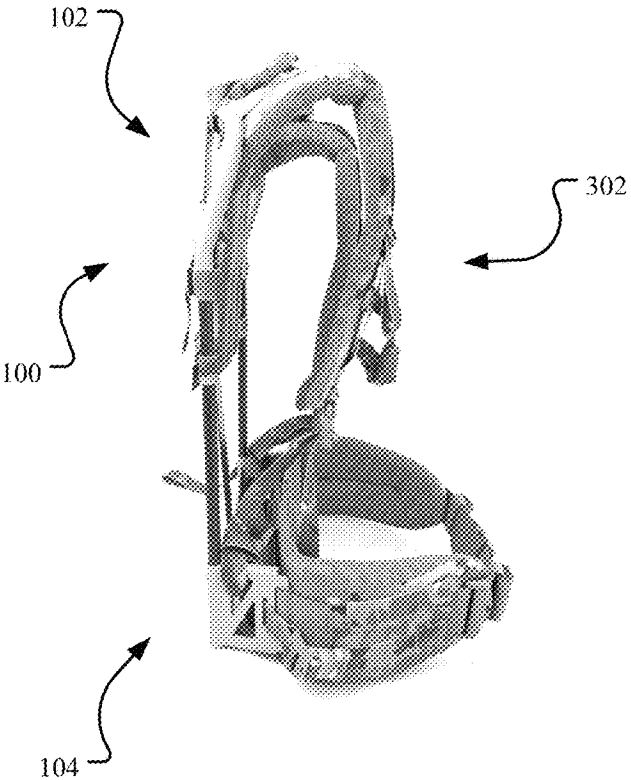
Figure 23:
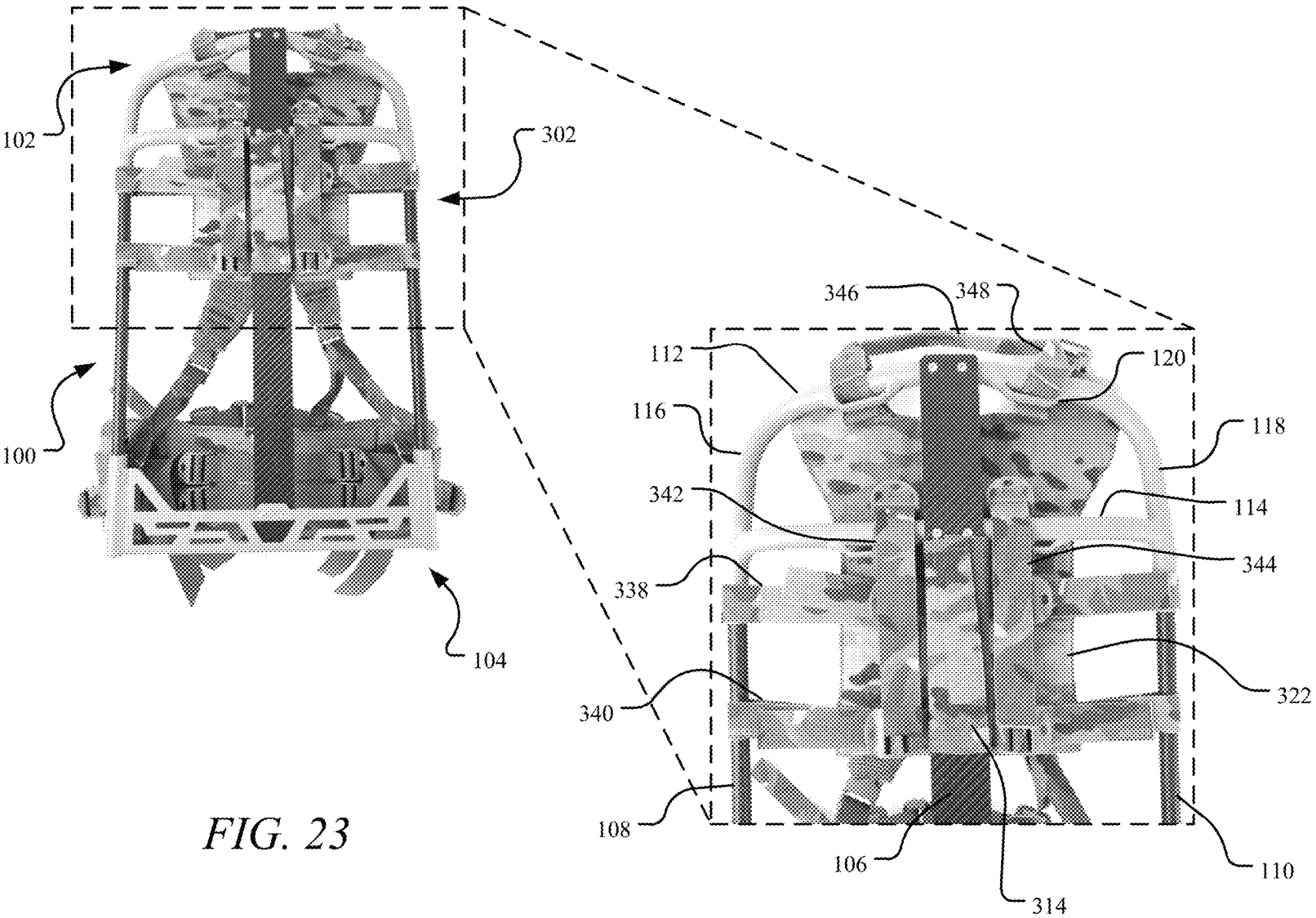
FIG. 23 is a back view and a detailed view of the yoke engaged directly to the frame.
Figure 24A:
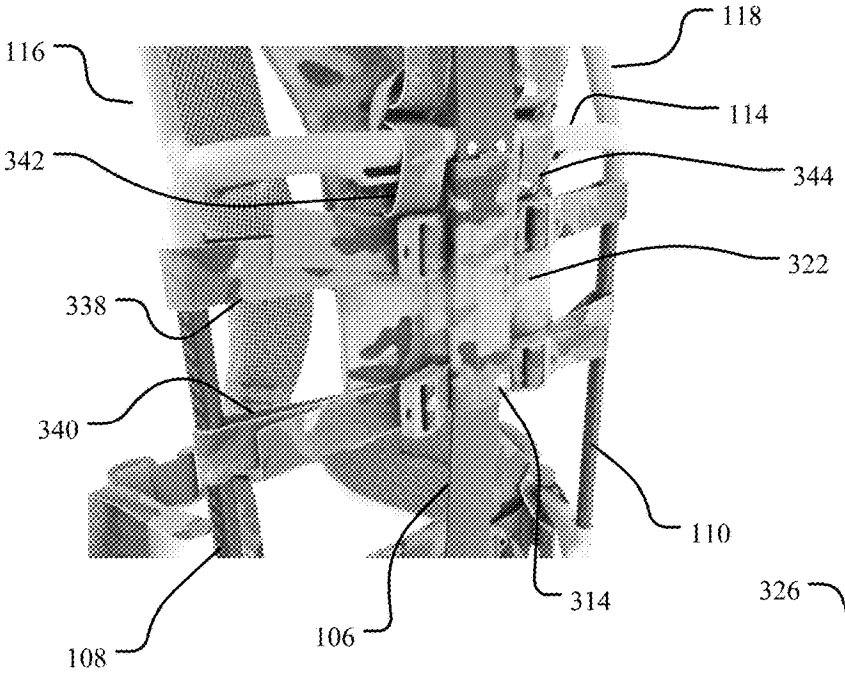
FIGS. 24A-24B show detailed perspective side and front views, respectively, of the yoke engaged directly to the frame.
Figure 24B:
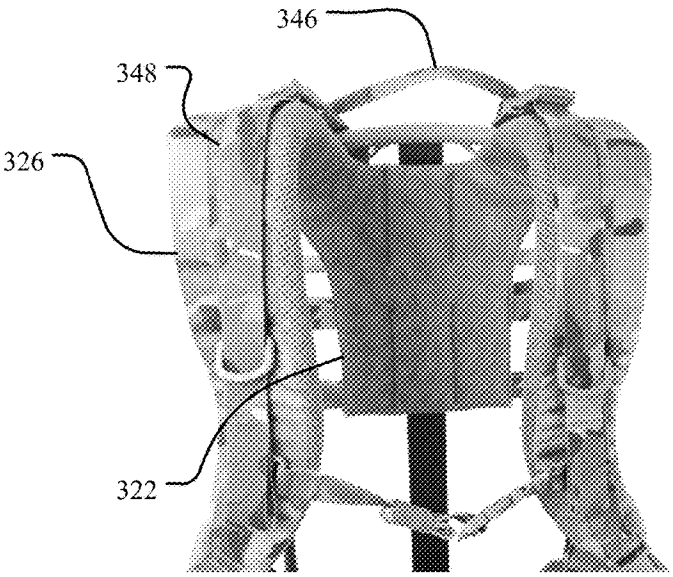

FIG. 18 shows the base belt 304 laid flat for mounting to the frame base 104. In one implementation, the base belt 304 includes one or more belt retention strap(s) 330 and one or more corresponding securing buckles 332 attached to a belt support 336. The belt support 336 may include padding and is adapted to contact the waist of the individual. The base belt 304 may further include a belt adapter 334 with a male portion and a female portion. Turning to FIGS. 19A-19D, in one implementation, the frame base 104 is positioned on the base belt 304, and the base retention straps 330 are inserted through the openings 132 and secured using the securing buckles 332. As shown in FIGS. 20A-20B, the belt adapter 334 is connected to the belt support 336. The base belt 304 is shown secured to the frame base 104 in FIG. 21.

Turning to FIGS. 22A-24B, in one implementation, the yoke 302 is engaged directly to the load carriage frame 100 at the proximal end without the yoke adapter 306. In this case, the yoke 302 includes one or more horizontal straps extending from the yoke support 322 and engaging the yoke 302 to the first tube 108 and the second tube 110 and/or the first and second side bars 116 and 118. For example, the horizontal straps may include a set of one or more proximal horizontal straps 338 each extending from the yoke support 322 around the first tube 108 and the second tube 110 and back to the yoke support 322 where the set of proximal horizontal straps 338 are each secured to the yoke support 322 via a releasable connection point, such as a buckle. The horizontal straps may further include a set of one or more distal horizontal straps 340 each extending from the yoke support 322 around the first tube 108 and the second tube 110 and back to the yoke support 322 where the set of distal horizontal straps 340 are each secured to the yoke support 322 via a releasable connection point, such as a buckle. Once secured, the proximal horizontal straps 338 may be disposed distal to the distal bar 114, and the distal horizontal straps 340 may be disposed at a distal end of the yoke support 332.

The yoke 302 may further include one or more vertical straps extending from the yoke support 322 and engaging the yoke 302 to the distal bar 114. For example, the vertical straps may include a first vertical strap 342 and a second vertical strap 344 each extending from the yoke support 322 around the distal tube 114 and back to the yoke support 322 where the first vertical strap 342 and the second vertical strap 344 are each secured to the yoke support 322 via a releasable connection point, such as a buckle. Once secured, the first vertical strap 342 may be disposed along the yoke support 322 on a first side between the spine 106 and the first tube 108, and the second vertical strap 344 may be disposed along the yoke support 322 on a second side between the spine 106 and the second tube 110.

In one implementation, the spine straps 314 extend from the yoke support 322 and are mounted to the spine 106. As described herein, in one implementation, the shock absorber support 320 may be positioned against the spine 106, for example, on the front side, using the spine straps 324.

The yoke 322 may further be engaged to the proximal bar 112. In one implementation, a set of proximal yoke straps 348 extend from the yoke support 322 and loop through the proximal eyelets 120 for securing to the yoke support 322 via a releasable connection point, such as a buckle. A handle 346 may be formed between the set of proximal yoke straps 348. In one implementation, each of the set of proximal yoke straps 348 extend along one of the yoke arms 326. It will be appreciated that the yoke 302 may be attached to the load carriage frame 100 directly or indirectly (e.g., via the yoke adapter 306) in a variety of other manners.

Figure 25B:
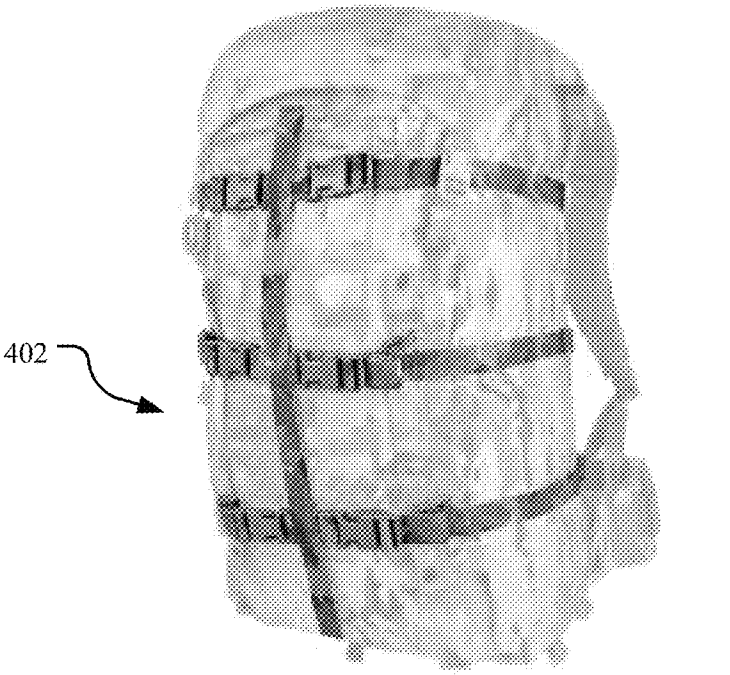
FIG. 25B illustrates the cinching strap assembly with an example ladder strap to compress the tactical pack.
Figure 25A:
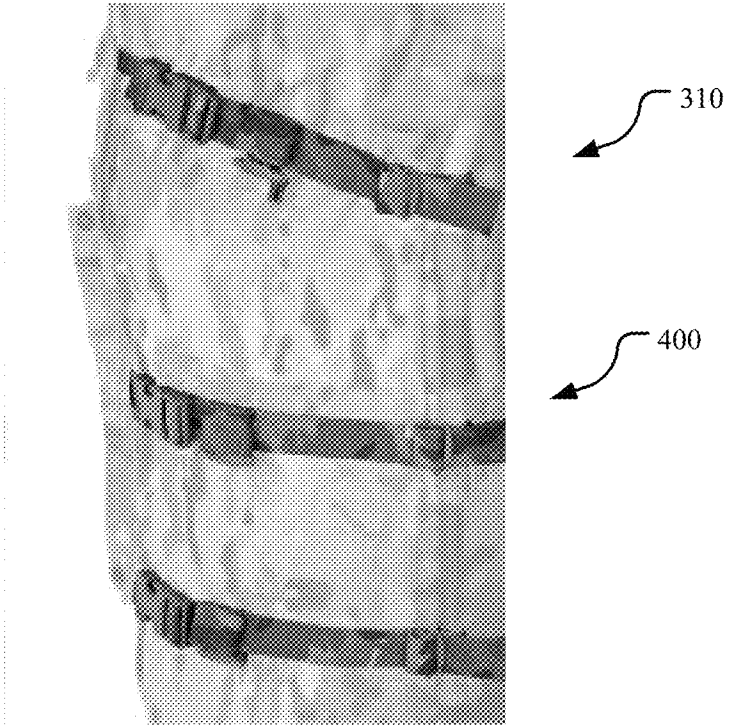
FIG. 25A illustrates an example cinching strap assembly for securing a load, such as a tactical pack.
Figure 26A:
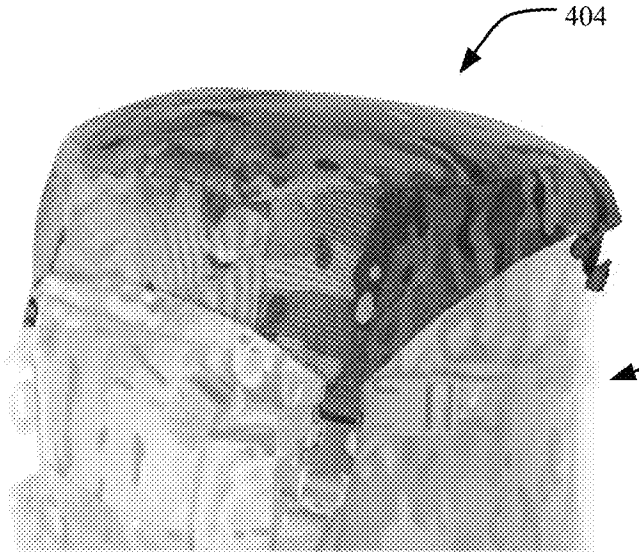
FIG. 26A illustrates an example cap for the tactical pack.

As described herein, the load 310 may take a variety of forms, for example tactical equipment, which may be a tactical pack. To compress the load 310, a cinching strap assembly 400 may be used, for example, as shown in FIG. 25A. The cinching strap assembly 400 may include one or more cinching straps extending transversely across the load 310. In one implementation, each of the cinching straps includes at least one male buckle portion and at least one female buckle portion and at least one loop. The cinching straps may each be secured to the first tube 108 or the second tube 110, for example, via a tri-glide. The cinching straps may extend through one or more loops of the load 310. As shown in FIG. 25B, in one implementation, a ladder strap 402 may be inserted through the cinching strap assembly 400 to further compress the load 310 from the rear. The ladder strap 402 may include additional buckles to connect to the buckles of the cinching straps. Referring to FIG. 26A, in one implementation, a cap 404 may be attached to a top of the load 310. The cap 404 may be flush with the top of the load 310 and attached using one or more snaps and/or cap buckle straps. The cap 404 may include mesh pockets, webbing, and/or the like for additional storage or to MOLLE additional equipment to the load 310.

Figure 26B:
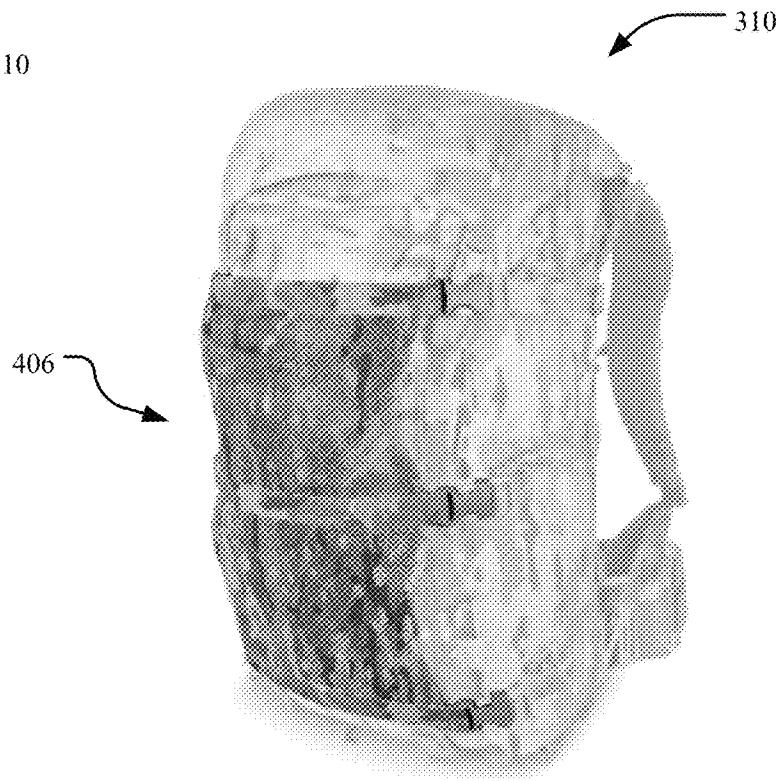
FIG. 26B shows an example mesh pocket to compress the tactical pack and provide additional storage.

FIG. 26B shows a mesh pocket 406 that may be used to compress the load 310 from the rear and add additional storage, for example, internal pockets. The mesh pocket 406 may be mounted to the load carriage frame 100 with or without the cinching strap assembly 400. For example, it may be mounted with the cinching strap assembly 400 similar to the ladder strap 402. Alternatively, it may be mounted directly to the load carriage frame 100 similar to the cinching strap assembly 400. Various other pockets, pouches, mesh, packs, and/or other tactical equipment, storage, or connectors may be mounted to the load carriage frame 100, the load carriage assembly 300, and/or the load 310. The pouches and/or pockets may be foam insulated.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

The directional term inward generally indicates a direction towards a user when wearing the load carriage apparatus, and the directional term outward generally indicates a direction away from the user when wearing the load carriage apparatus.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A load carriage apparatus comprising:

a rigid frame top disposed at a proximal end of a load carriage frame, the frame top including a proximal bar and a distal bar each extending between a first side bar and a second side bar;

a rigid frame base disposed at a distal end of the load carriage frame, the frame base including a rear portion connected to a first side portion and a second side portion;

a spine made from a first flexible material connecting a center portion of the proximal bar of the frame top to the rear portion of the frame base, a length of the first side portion extending in a first direction away from the spine and a length of the second side portion extending in a second direction away from the spine, the first direction being different from the second direction such that the first side portion and the second side portion are oriented in a non-parallel relationship with each other;

a first tube made form a second flexible material extending from the first side bar to the frame base relative to the first side portion; and a second tube made form the second flexible material extending from the second side bar to the frame base relative to the second side portion.

2. The load carriage apparatus of claim 1, further comprising:

a yoke having a set of yoke arms extending from a yoke support, the yoke support releasably engaged to the load carriage frame.

3. The load carriage apparatus of claim 2, wherein the yoke support is engaged to the load carriage frame with a yoke adapter.

4. The load carriage apparatus of claim 2, wherein the yoke support is engaged to the proximal end of the load carriage frame at one or more of the frame top, the spine, the first tube, and the second tube.

5. The load carriage apparatus of claim 1, further comprising:

a base belt releasably engaged to the frame base.

6. The load carriage apparatus of claim 5, wherein the base belt is releasably engaged to the first side portion and the second side portion of the frame base.

7. The load carriage apparatus of claim 1, further comprising:

a shock absorber positioned against the spine using one or more spine straps.

8. The load carriage apparatus of claim 1, wherein the rear portion of the frame base is oriented at an obtuse angle relative to each of the first side portion and the second side portion.

9. The load carriage apparatus of claim 8, wherein the obtuse angle is 109 degrees.

10. The load carriage apparatus of claim 1, wherein the first side bar and the second side bar of the frame top each include a distal section connected to a proximal section by a transition section, the proximal sections each extending inwardly at an angle relative to the distal section.

11. The load carriage apparatus of claim 10, wherein the angle is 20 degrees.

12. The load carriage apparatus of claim 1, wherein the first side bar and the second side bar of the frame top each include a proximal section, the proximal sections each transitioning to the proximal bar at a connection portion, the connecting portions each extending along a contour from the proximal section to a furthest inward point and from the furthest inward point to a furthest outward point disposed in the center portion of the proximal bar.

13. The load carriage apparatus of claim 1, wherein the distal bar includes a crossbar portion extending between a first end portion and a second end portion, each of the first end portion and the second end portion disposed at an angle relative to the crossbar portion.

14. The load carriage apparatus of claim 13, wherein the angle is 25 degrees.

15. The load carriage apparatus of claim 1, wherein the first tube is engaged to the frame base at a first receiver disposed between the rear portion and the first side portion and the second tube is engaged to the frame base at a second receiver disposed between the rear portion and the second side portion.

16. The load carriage apparatus of claim 1, wherein the spine is adapted to reverberate energy.

17. A load carriage apparatus comprising:

a rigid frame top disposed at a proximal end of a load carriage frame, the frame top including a proximal bar and a distal bar each extending between a first side bar and a second side bar;

a rigid frame base disposed at a distal end of the load carriage frame, the frame base including a rear portion connected to a first side portion and a second side portion, a length of the first side portion extending in a first direction away from a center of the rear portion and a length of the second side portion extending in a second direction away from the center of the rear portion, the first direction being different from the second direction such that the first side portion and the second side portion are oriented in a non-parallel relationship with each other;

a spine made of a first flexible material configured to dynamically couple the frame top to the frame base, wherein the spine is adapted to reverberate energy;

a first tube made form a second flexible material extending from the first side bar to the frame base relative to the first side portion; and a second tube made form the second flexible material extending from the second side bar to the frame base relative to the second side portion.

18. The load carriage apparatus of claim 17, wherein the rear portion of the frame base is oriented at an obtuse angle relative to each of the first side portion and the second side portion.

19. The load carriage apparatus of claim 17, wherein the first side bar and the second side bar of the frame top each include a proximal section, the proximal sections each transitioning to the proximal bar at a connection portion, the connecting portions each extending along a contour from the proximal section to a furthest inward point and from the furthest inward point to a furthest outward point disposed in the center portion of the proximal bar.

20. The load carriage apparatus of claim 17, wherein the first side portion and the second side portion each further extend inwardly from a receiver to a front edge.

* * * * *